US010920161B2

(12) United States Patent
Patil et al.

(10) Patent No.: US 10,920,161 B2
(45) **Date of Patent: *Feb. 16, 2021**

(54) LOW TRANSITION TEMPERATURE MIXTURES OR DEEP EUTECTIC SOLVENTS AND PROCESSES FOR PREPARATION THEREOF

(71) Applicant: ExxonMobil Research and Engineering Company, Annandale, NJ (US)

(72) Inventors: Abhimanyu O. Patil, Westfield, NJ (US); Satish Bodige, Wayne, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 190 days.

This patent is subject to a terminal disclaimer.

(21) Appl. No.: 15/927,201

(22) Filed: Mar. 21, 2018

(65) Prior Publication Data

US 2018/0223211 A1 Aug. 9, 2018

Related U.S. Application Data

(62) Division of application No. 14/881,522, filed on Oct. 13, 2015, now Pat. No. 9,957,459.
(Continued)

(51) Int. Cl.
*C10M 105/74* (2006.01)
*C10M 105/62* (2006.01)
(Continued)

(52) U.S. Cl.
CPC ..... *C10M 105/74* (2013.01); *C10M 105/00* (2013.01); *C10M 105/62* (2013.01);
(Continued)

(58) Field of Classification Search
CPC ..... C10M 105/00; C10M 105/74; C10M 105/62; C10M 105/70
See application file for complete search history.

(56) References Cited

U.S. PATENT DOCUMENTS 1,815,022 A 7/1931 Davis
2,015,748 A 10/1935 Frolich
(Continued)

FOREIGN PATENT DOCUMENTS

CA 1094044 A1 1/1981
EP 0471071 B1 2/1991
(Continued)

OTHER PUBLICATIONS

Francisco et al., "A new low transition temperature mixture (LTTM) formed by choline chloride + lactic acid: characterization as solvent for CO2 capture", Fluid Phase Equilibria, 2013, pp. 77-84, vol. 340.
(Continued)

*Primary Examiner* — Ellen M McAvoy
(74) *Attorney, Agent, or Firm* — Priya G. Prasad

(57) ABSTRACT

A low transition temperature mixture (LTTM) or deep eutectic solvent (DES) useful as a lubricating oil base stock and lubricating oil including a eutectic mixture of at least a first component and at least a second component. The at least first component comprises a hydrogen bond acceptor and the at least second component comprises a hydrogen bond donor. The eutectic mixture includes an equilibrium phase between the at least first component and the at least second component. The equilibrium phase does not exhibit physical characteristics of the at least first component in an unmixed state and the at least second component in an unmixed state. The at least first component and the at least second component form an intermolecular interaction between each other sufficient to prevent crystallization of the at least first
(Continued)

| Base Stock # | LTTM # | $Kv_{100}$, cSt | $Kv_{40}$, cSt | Viscosity Index |
|---|---|---|---|---|
| Example 1 | 1 | 35.28 | 468.45 | 113 |
| Example 2 | 2 | 34.39 | 435.60 | 117 |
| Example 3 | 3 | 57.31 | 272.67 | 130 |
| Example 4 | 4 | 81.43 | 1749.00 | 110 |
| Example 5 | 5 | High viscosity | High viscosity | High viscosity |
| Example 6 | 6 | 9.07 | 73.34 | 96 |
| Example 7 | 7 | 8.74 | 75.04 | 86 |
| Example 8 | 8 | 26.20 | 410.29 | 86 |
| Example 9 | 9 | 29.24 | 432.56 | 95 |
| Example 10 | 10 | 35.74 | 486.49 | 112 |
| Example 11 | 11 | 19.60 | 202.99 | 110 |
| Example 12 | 12 | 11.32 | 90.09 | 113 |
| Example 13 | 13 | 26.20 | 410.29 | 86 |

component and the at least second component in the eutectic mixture. The eutectic mixture is a liquid at 20° C.

20 Claims, 8 Drawing Sheets

Related U.S. Application Data

(60) Provisional application No. 62/074,137, filed on Nov. 3, 2014.

(51) Int. Cl.

| | |
|---|---|
| ***C10M 105/70*** | (2006.01) |
| ***C10M 171/00*** | (2006.01) |
| ***C10M 105/00*** | (2006.01) |
| *C10N 20/00* | (2006.01) |
| *C10N 30/06* | (2006.01) |
| *C10N 30/00* | (2006.01) |
| *C10N 40/25* | (2006.01) |

(52) U.S. Cl.

CPC ..... *C10M 105/70* (2013.01); *C10M 171/00* (2013.01); *C10M 2207/0225* (2013.01); *C10M 2207/124* (2013.01); *C10M 2207/1233* (2013.01); *C10M 2207/1443* (2013.01); *C10M 2207/2895* (2013.01); *C10M 2215/023* (2013.01); *C10M 2215/0425* (2013.01); *C10M 2215/061* (2013.01); *C10M 2215/064* (2013.01); *C10M 2215/2245* (2013.01); *C10M 2223/0603* (2013.01); *C10N 2020/077* (2020.05); *C10N 2030/06* (2013.01); *C10N 2030/54* (2020.05); *C10N 2040/25* (2013.01)

(56) References Cited

U.S. PATENT DOCUMENTS

| | | | |
|---|---|---|---|
| 2,100,993 | A | 11/1937 | Bruson |
| 2,191,498 | A | 2/1940 | Reiff |
| 2,387,501 | A | 10/1945 | Dietrich |
| 2,655,479 | A | 10/1953 | Munday et al. |
| 2,666,746 | A | 1/1954 | Munday et al. |
| 2,721,877 | A | 10/1955 | Popkin et al. |
| 2,721,878 | A | 10/1955 | Popkin |
| 2,817,693 | A | 12/1957 | Koome et al. |
| 3,036,003 | A | 5/1962 | Verdol |
| 3,087,936 | A | 4/1963 | Le Suer |
| 3,172,892 | A | 3/1965 | Le Suer et al. |
| 3,200,107 | A | 8/1965 | Le Suer |
| 3,215,707 | A | 11/1965 | Rense |
| 3,219,666 | A | 11/1965 | Norman et al. |
| 3,250,715 | A | 5/1966 | Wyman |
| 3,254,025 | A | 5/1966 | Le Suer |
| 3,272,746 | A | 9/1966 | Le Suer et al. |
| 3,275,554 | A | 9/1966 | Wagenaar |
| 3,316,177 | A | 4/1967 | Dorer, Jr. |
| 3,322,670 | A | 5/1967 | Burt et al. |
| 3,329,658 | A | 7/1967 | Fields |
| 3,341,542 | A | 9/1967 | Le Suer et al. |
| 3,382,291 | A | 5/1968 | Brennan |
| 3,413,347 | A | 11/1968 | Worrel |
| 3,438,757 | A | 4/1969 | Honnen et al. |
| 3,444,170 | A | 5/1969 | Norman et al. |
| 3,449,250 | A | 6/1969 | Fields |
| 3,454,555 | A | 7/1969 | van der Voort et al. |
| 3,454,607 | A | 7/1969 | Le Suer et al. |
| 3,519,565 | A | 7/1970 | Coleman |
| 3,541,012 | A | 11/1970 | Stuebe |
| 3,565,804 | A | 2/1971 | Honnen et al. |
| 3,595,791 | A | 7/1971 | Cohen |
| 3,630,904 | A | 12/1971 | Musser et al. |
| 3,632,511 | A | 1/1972 | Liao |
| 3,652,616 | A | 3/1972 | Watson et al. |
| 3,666,730 | A | 5/1972 | Coleman |
| 3,687,849 | A | 8/1972 | Abbott |
| 3,697,574 | A | 10/1972 | Pisek et al. |
| 3,702,300 | A | 11/1972 | Coleman |
| 3,703,536 | A | 11/1972 | Piasek et al. |
| 3,704,308 | A | 11/1972 | Piasek et al. |
| 3,725,277 | A | 4/1973 | Worrel |
| 3,725,480 | A | 4/1973 | Traise et al. |
| 3,726,882 | A | 4/1973 | Traise et al. |
| 3,742,082 | A | 6/1973 | Brennan |
| 3,751,365 | A | 8/1973 | Piasek et al. |
| 3,755,433 | A | 8/1973 | Miller et al. |
| 3,756,953 | A | 9/1973 | Piasek et al. |
| 3,769,363 | A | 10/1973 | Brennan |
| 3,787,374 | A | 1/1974 | Adams |
| 3,798,165 | A | 3/1974 | Piasek et al. |
| 3,803,039 | A | 4/1974 | Piasek et al. |
| 3,822,209 | A | 7/1974 | Knapp et al. |
| 3,876,720 | A | 4/1975 | Heilman et al. |
| 3,948,800 | A | 4/1976 | Meinhardt |
| 4,100,082 | A | 7/1978 | Clason et al. |
| 4,149,178 | A | 4/1979 | Estes |
| 4,218,330 | A | 8/1980 | Shubkin |
| 4,234,435 | A | 11/1980 | Meinhardt et al. |
| 4,239,930 | A | 12/1980 | Allphin et al. |
| 4,367,352 | A | 1/1983 | Watts, Jr. et al. |
| 4,413,156 | A | 11/1983 | Watts, Jr. et al. |
| 4,426,305 | A | 1/1984 | Malec |
| 4,434,408 | A | 2/1984 | Baba et al. |
| 4,454,059 | A | 6/1984 | Pindar et al. |
| 4,594,172 | A | 6/1986 | Sie |
| 4,767,551 | A | 8/1988 | Hunt et al. |
| 4,798,684 | A | 1/1989 | Salomon |
| 4,827,064 | A | 5/1989 | Wu |
| 4,827,073 | A | 5/1989 | Wu |
| 4,897,178 | A | 1/1990 | Best et al. |
| 4,910,355 | A | 3/1990 | Shubkin et al. |
| 4,921,594 | A | 5/1990 | Miller |
| 4,943,672 | A | 7/1990 | Hamner et al. |
| 4,952,739 | A | 8/1990 | Chen |
| 4,956,122 | A | 9/1990 | Watts et al. |
| 4,975,177 | A | 12/1990 | Garwood et al. |
| 5,068,487 | A | 11/1991 | Theriot |
| 5,075,269 | A | 12/1991 | Degnan et al. |
| 5,084,197 | A | 1/1992 | Galic et al. |
| 5,430,105 | A | 7/1995 | Redpath et al. |
| 5,705,458 | A | 1/1998 | Roby et al. |
| 6,034,039 | A | 3/2000 | Gomes et al. |
| 6,080,301 | A | 6/2000 | Berlowitz et al. |
| 6,090,989 | A | 7/2000 | Trewella et al. |
| 6,130,190 | A | 10/2000 | Gunsel et al. |
| 6,165,949 | A | 12/2000 | Berlowitz et al. |
| 6,323,164 | B1 | 11/2001 | Liesen et al. |
| 7,018,960 | B2 | 3/2006 | Negoro et al. |
| 7,485,604 | B2 | 2/2009 | Negoro et al. |
| 7,704,930 | B2 | 4/2010 | Deckman et al. |
| 7,735,461 | B2 | 6/2010 | Vetrovec |
| 8,048,833 | B2 | 11/2011 | Habeeb et al. |
| 9,957,459 | B2 * | 5/2018 | Patil ..... C10M 105/00 |
| 2008/0020950 | A1 | 1/2008 | Gray et al. |
| 2009/0247432 | A1 * | 10/2009 | Miller ..... C09K 8/03 507/240 |
| 2012/0028855 | A1 | 2/2012 | Miller |
| 2014/0259887 | A1 | 9/2014 | Kornfield et al. |
| 2015/0094459 | A1 * | 4/2015 | Kroon ..... C08H 8/00 530/507 |
| 2016/0236939 | A1 * | 8/2016 | De Miguel Turullois ..... B82Y 30/00 |
| 2017/0157717 | A1 | 6/2017 | Ryder et al. |
| 2017/0182485 | A1 * | 6/2017 | Uppara ..... B01J 31/0247 |
| 2018/0223210 | A1 * | 8/2018 | Patil ..... C10M 111/02 |

FOREIGN PATENT DOCUMENTS

| | | | |
|---|---|---|---|
| EP | 0464547 | A1 | 6/1991 |
| EP | 0464546 | A1 | 1/1992 |
| EP | 2597099 | A1 | 11/2011 |
| GB | 1350257 | A | 4/1974 |
| GB | 1390359 | A | 4/1975 |

(56) References Cited

FOREIGN PATENT DOCUMENTS

| | | | |
|---|---|---|---|
| GB | 1429494 | A | 3/1976 |
| GB | 1440230 | A | 6/1976 |
| WO | 199924533 | A1 | 5/1999 |
| WO | 2013153203 | A1 | 10/2013 |

OTHER PUBLICATIONS

Abbott et al., "Deep Eutectic Solvents Formed between Choline Chloride and Carboxylic Acids: Versatile Alternatives to Ionic Liquids", Journal of the American Chemical Society, 2004, pp. 9142-9147, vol. 126.

Abbott et al., "Evaluating water miscible deep eutectic solvents (DESs) and ionic liquids as potential lubricants", Green Chemistry, 2014, pp. 4156-4161. vol. 16.

Shi et al., "Friction and Wear Behavior of CF/PTFE Composites Lubricated by Choline Chloride Ionic Liquids", Tribology Letters, 2013, pp. 413-420, vol. 49, No. 2.

Russ et al., "Low melting mixtures in organic synthesis—an alternative to ionic liquids?", Green Chemistry, 2012, pp. 2969-2982, vol. 14, No. 11.

Francisco et al., "Low-Transition-Temperature Mixtures (LTTMs): A New Generation of Designer Solvents", Angewandte Chemie International Edition, 2013, pp. 3074-3085, vol. 52, No. 11.

Francisco et al., "New natural and renewable low transition temperature mixtures (LTTMs): screening as solvents for lignocellulosic biomass processing", Green Chemistry, 2012, pp. 2153-2157, vol. 14, No. 8.

Abbott et al., "Novel solvent properties of choline chloride/urea mixtures", Chemical Communications, 2003, pp. 70-71.

Kareem et al., "Phosphonium-Based Ionic Liquids Analogues and Their Physical Properties", Journal of Chemical & Engineering Data, 2010, pp. 4632-4637, vol. 55, No. 11.

Zhang et al., "Properties and Applications of Choline-Based Deep Eutectic Solvents", Progress in Chemistry, pp. 881-892, vol. 25, No. 6.

Tang et al., "Recent developments in deep eutectic solvents in chemical sciences", Monatshefte fuer Chemie, 2013, pp. 1427-1454, vol. 44, No. 10.

Abbott et al., "Design of Improved Deep Eutectic Solvents Using Hole Theory", ChemPhysChem, 2006, pp. 303-806, vol. 7, No. 4.

Durand et al., "Deep eutectic solvents: Synthesis, application, and focus on lipase-catalyzed reactions", European Journal of Lipid Science and Technology, 2013, pp. 379-385, vol. 115, No. 4.

Zhang et al., "Properties and applications of choline chloride/urea and choline chloride/glycerol", Scientia Sinica Chimica, 2014, pp. 927-941. vol. 44, No. 6.

Habibi et al., "A novel digestion method based on a choline chloride-oxalic acid deep eutectic solvent for determining Cu, Fe, and Zn in fish samples", Analytica Chimica Acta, 2013, pp. 61-67, vol. 762.

International Search Report and Written Opinion PCT/US2015/055245 dated Dec. 22, 2015.

* cited by examiner

Fig. 1

| Base Stock # | LTTM # | $Kv_{100}$, cSt | $Kv_{40}$, cSt | Viscosity Index |
|---|---|---|---|---|
| Example 1 | 1 | 35.28 | 468.45 | 113 |
| Example 2 | 2 | 34.39 | 435.60 | 117 |
| Example 3 | 3 | 57.31 | 272.67 | 130 |
| Example 4 | 4 | 81.43 | 1749.00 | 110 |
| Example 5 | 5 | High viscosity | High viscosity | High viscosity |
| Example 6 | 6 | 9.07 | 73.34 | 96 |
| Example 7 | 7 | 8.74 | 75.04 | 86 |
| Example 8 | 8 | 26.20 | 410.29 | 86 |
| Example 9 | 9 | 29.24 | 432.56 | 95 |
| Example 10 | 10 | 35.74 | 486.49 | 112 |
| Example 11 | 11 | 19.60 | 202.99 | 110 |
| Example 12 | 12 | 11.32 | 90.09 | 113 |
| Example 13 | 13 | 26.20 | 410.29 | 86 |

Fig. 2

| Base Stock # | LTTM # | PAO4 | A51 (Ester) | Alkylated Naphthalene (AN5) |
|---|---|---|---|---|
| Example 1 | 1 | 5% cloudy | 5% clear | 5% clear |
| Example 2 | 2 | 5% cloudy | 5%, 20% clear | 5%, 20% clear |
| Example 3 | 3 | 5% cloudy | 5% cloudy | 5% cloudy |
| Example 4 | 4 | 5% cloudy | 5% cloudy | 5% cloudy |
| Example 5 | 5 | | | |
| Example 6 | 6 | 5% cloudy | 5% cloudy | 5% cloudy |
| Example 7 | 7 | 5% cloudy | 5% cloudy | 5% cloudy |
| Example 8 | 8 | 5% cloudy | 5% clear | 5% clear |
| Example 9 | 9 | 5% cloudy | 5% clear | 5% cloudy |
| Example 10 | 10 | 5% cloudy | 5% clear | 5% clear |
| Example 11 | 11 | 5% cloudy | 5% clear | 5% clear |
| Example 12 | 12 | 5% cloudy | 5% cloudy | 5% cloudy |
| Example 13 | 13 | 5% cloudy | 5% clear | 5% clear |

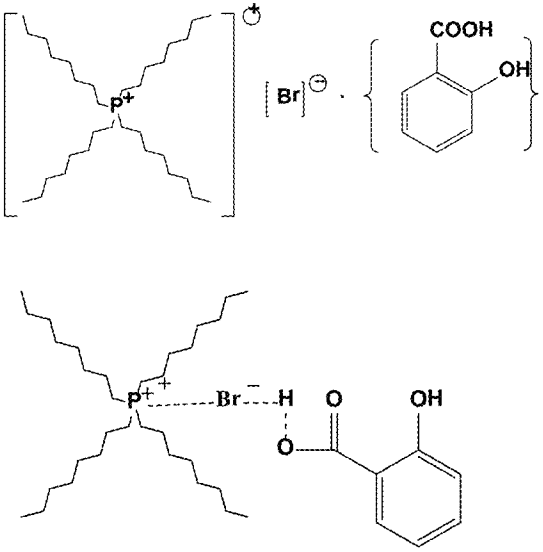
Fig 8
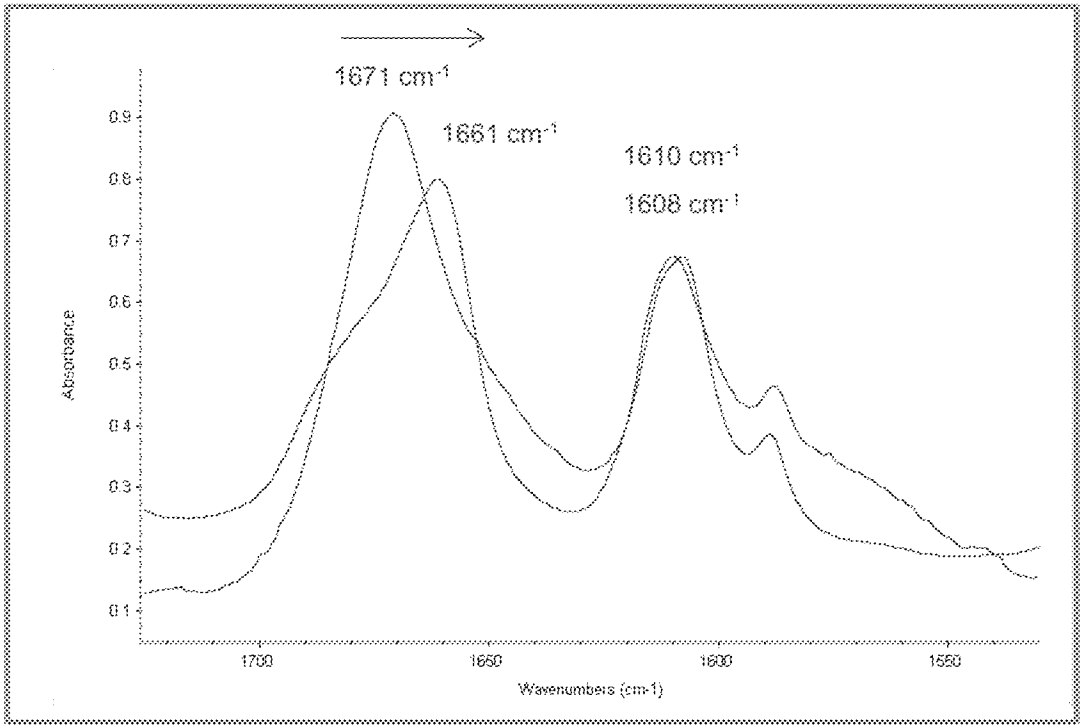

LOW TRANSITION TEMPERATURE MIXTURES OR DEEP EUTECTIC SOLVENTS AND PROCESSES FOR PREPARATION THEREOF

CROSS-REFERENCE TO RELATED APPLICATIONS

This application is a divisional application filed under 37 C.F.R. 1.53(b) of parent U.S. patent application Ser. No. 14/881,522, the entirety of which is hereby incorporated herein by reference, and claims priority to U.S. patent application Ser. No. 14/881,522 filed on Oct. 13, 2015 which claims priority to U.S. Provisional Application No. 62/074,137 filed Nov. 3, 2014, also herein incorporated by reference in its entirety.

FIELD

This disclosure provides low transition temperature mixtures (LTTMs) or deep eutectic solvents (DESs) that are liquid, substantially anhydrous, eutectic mixtures having at least two components that can be used as synthetic base stocks, co-base stocks, functional fluids, and/or lubricant additives. This disclosure also provides a process for producing the LTTMs or DESs, a lubricating oil base stock and lubricating oil containing the LTTMs or DESs, and a method for improving wear control and/or reducing friction, while maintaining or improving fuel efficiency, by using as the lubricating oil a formulated oil containing the LTTM or DES. The lubricating engine oils are useful in internal combustion engines.

BACKGROUND

A major challenge in engine oil formulation is simultaneously achieving wear control, and friction reduction, while also maintaining fuel economy performance, over a broad temperature range.

Lubricant-related wear control is highly desirable due to increasing use of low viscosity engine oils for improved fuel efficiency. As governmental regulations for vehicle fuel consumption and carbon emissions become more stringent, use of low viscosity engine oils to meet the regulatory standards is becoming more prevalent. At the same time, lubricants need to provide a substantial level of wear protection and friction reduction due to the formation of thinner lubricant films during engine operation. As such, use of antiwear additives and friction modifiers in a lubricant formulation is the typical method for achieving wear control and friction reduction. Due to limitations of using high levels of antiwear and friction modifier additives such as catalyst poisoning and deposit formation, it is highly desirable to find alternative methods for achieving excellent wear control and friction reduction without poisoning the catalyst.

Developing more effective additive package in combination with balancing lubricant viscosity has proven to be a successful and cost-effective route to improving engine efficiency and durability. Commercial lubricants are composed of base stock and several categories of additives including anti-wear, friction modifier, viscosity modifier, antioxidant, detergent, dispersant, etc. Specifically, friction modifiers and anti-wear agents play key role in reducing boundary and mixed friction and wear in engine locations such as the top-ring-reversal region of the piston ring-cylinder liner interface and sliding surfaces in the valve train. Furthermore, an effective anti-wear additive allows using a low viscosity lubricant, consequently reducing elasto-hydrodynamic friction loss.

PAOs are important lube base stocks with many excellent lubricant properties, including high viscosity index (VI), low volatility and are available in various viscosity range ($Kv_{100}$ 2-300 cSt). However, PAOs are paraffinic hydrocarbons with low polarity. This low polarity leads to low solubility and dispersancy for polar additives or sludge generated during service. To compensate for this low polarity, lube formulators usually add one or multiple polar co-base stocks. Ester or alkylated naphthalene (AN) is usually present at 1 wt. % to 50 wt. % levels in many finished lubricant formulations to increase the fluid polarity which improves the solubility of polar additives and sludge.

There is a need for base stocks or multifunctional fluids with better properties and the lube products with differentiation features. Ionic liquids (ILs) have been an active are of research at various universities, government labs and companies. ILs are effective lube additives but have known disadvantages (e.g., toxicity, high cost, limited range of available raw materials, and purity difficulties).

Despite advances in lubricant oil formulation technology, there exists a need for an engine oil lubricant that effectively improves wear control while maintaining or improving fuel efficiency. In addition, there exists a need for an engine oil lubricant that effectively improves wear control and friction reduction while maintaining or improving fuel efficiency.

SUMMARY

This disclosure relates in part to LTTMs or DESs that are liquid, substantially anhydrous, eutectic mixtures having at least two components that can be used as synthetic base stocks, co-base stocks, functional fluids, and/or lubricant additives. This disclosure also provides a process for producing the LTTMs or DESs, a lubricating oil base stock and lubricating oil containing the LTTMs or DESs, and a method for improving wear control and/or reducing friction, while maintaining or improving fuel efficiency, by using as the lubricating oil a formulated oil containing the LTTM or DES. The lubricating engine oils are useful in internal combustion engines.

This disclosure also relates in part to a composition comprising a eutectic mixture of at least a first component and at least a second component. The at least first component comprises a hydrogen bond acceptor and the at least second component comprises a hydrogen bond donor. The eutectic mixture comprises an equilibrium phase between the at least first component and the at least second component. The equilibrium phase does not exhibit physical characteristics of the at least first component in an unmixed state and the at least second component in an unmixed state. The at least first component and the at least second component form an intermolecular interaction between each other sufficient to prevent crystallization of the at least first component and the at least second component in the eutectic mixture. The eutectic mixture is a liquid at 20° C.

This disclosure further relates in part to a process that involves providing at least a first component and at least a second component in which the at least first component and the at least second component are solids at 20° C. The at least first component comprises a hydrogen bond acceptor and the at least second component comprises a hydrogen bond donor. The process further involves heating either the at least first component or the at least second component, whichever has the lowest melting point, at a temperature sufficient to melt either the at least first component or the at least second component having the lowest melting point. The process yet further involves dissolving either the at least first component or the at least second component, whichever does not have the lowest melting point, in either the melted at least first component or the melted at least second component, to form a eutectic mixture. The eutectic mixture contains an equilibrium phase between the at least first component and the at least second component, and the equilibrium phase does not exhibit physical characteristics of the at least first component and the at least second component. The at least first component and the at least second component form an intermolecular interaction between each other sufficient to prevent crystallization of the at least first component and the at least second component in the eutectic mixture. The eutectic mixture is a liquid at 20° C.

This disclosure yet further relates in part to a lubricating oil base stock that comprises a eutectic mixture containing at least a first component and at least a second component. The at least first component comprises a hydrogen bond acceptor and the at least second component comprises a hydrogen bond donor. The eutectic mixture comprises an equilibrium phase between the at least first component and the at least second component, and the equilibrium phase does not exhibit physical characteristics of the at least first component in an unmixed state and the at least second component in an unmixed state. The at least first component and the at least second component form an intermolecular interaction between each other sufficient to prevent crystallization of the at least first component and the at least second component in the eutectic mixture. The eutectic mixture is a liquid at 20° C.

This disclosure also relates in part to a lubricating engine oil having a composition comprising a lubricating oil base stock as a major component; and a eutectic mixture co-base stock, as a minor component. The eutectic mixture co-base stock comprises at least a first component and at least a second component. The at least first component comprises a hydrogen bond acceptor and the at least second component comprises a hydrogen bond donor. The eutectic mixture comprises an equilibrium phase between the at least first component and the at least second component, and the equilibrium phase does not exhibit physical characteristics of the at least first component in an unmixed state and the at least second component in an unmixed state. The at least first component and the at least second component form an intermolecular interaction between each other sufficient to prevent crystallization of the at least first component and the at least second component in the eutectic mixture. The eutectic mixture is a liquid at 20° C.

This disclosure further relates in part to a multifunctional functional fluid comprising a eutectic mixture containing at least a first component and at least a second component. The at least first component comprises a hydrogen bond acceptor and the at least second component comprises a hydrogen bond donor. The eutectic mixture comprises an equilibrium phase between the at least first component and the at least second component, and the equilibrium phase does not exhibit physical characteristics of the at least first component in an unmixed state and the at least second component in an unmixed state. The at least first component and the at least second component form an intermolecular interaction between each other sufficient to prevent crystallization of the at least first component and the at least second component in the eutectic mixture. The eutectic mixture is a liquid at 20° C.

This disclosure yet further relates in part to a method for improving wear control and/or reducing friction, while maintaining or improving fuel efficiency, in an engine lubricated with a lubricating oil by using as the lubricating oil a formulated oil. The formulated oil has a composition comprising a lubricating oil base stock as a major component, and a eutectic mixture co-base stock, as a minor component. The eutectic mixture co-base stock comprises at least a first component and at least a second component. The at least first component comprises a hydrogen bond acceptor and the at least second component comprises a hydrogen bond donor. The eutectic mixture comprises an equilibrium phase between the at least first component and the at least second component, and the equilibrium phase does not exhibit physical characteristics of the at least first component in an unmixed state and the at least second component in an unmixed state. The at least first component and the at least second component form an intermolecular interaction between each other sufficient to prevent crystallization of the at least first component and the at least second component in the eutectic mixture. The eutectic mixture is a liquid at 20° C.

In an embodiment, wear control is improved and/or friction is reduced and fuel efficiency is maintained or improved as compared to wear control and/or friction reduction and fuel efficiency achieved using a lubricating engine oil containing a co-base stock other than the eutectic mixture co-base stock.

It has been surprisingly found that, in accordance with this disclosure, lubricant acceptable eutectic mixtures can be prepared in accordance with a specifically defined process. The eutectic mixtures can provide for the delivery of additives (e.g., antioxidants, anti-wear, and friction modifiers) having limited solubility in lubricants in a controlled fashion or controlled release manner. The delivery can be triggered, for example, by heat, moisture, or other solvents. The liquid eutectic mixtures of this disclosure can overcome some of the limitations of ILs such as their toxicity, high cost, and difficulties in getting fluids to high purity. The liquid eutectic mixtures of this disclosure are advantageous in being inexpensive and easy to prepare from natural and readily available starting materials.

Other objects and advantages of the present disclosure will become apparent from the detailed description that follows.

BRIEF DESCRIPTION OF THE DRAWINGS

FIG. 1 shows lube properties of LTTMs as base stocks as set forth in Example 14 of this disclosure.

FIG. 2 shows solubility properties of LTTMs as set forth in Example 14 of this disclosure.

FIG. 8 shows Fourier Transform Infrared Spectroscopy (FTIR) of salicylic acid (blue) and tetraoctylphosphonium bromide and salicylic acid (red) the resultant liquid prepared in Example 2 of this disclosure. The FTIR shows shift in carbonyl group absorption peak of salicylic acid after LTTM formation due to hydrogen bonding.

DETAILED DESCRIPTION

Figure 3:
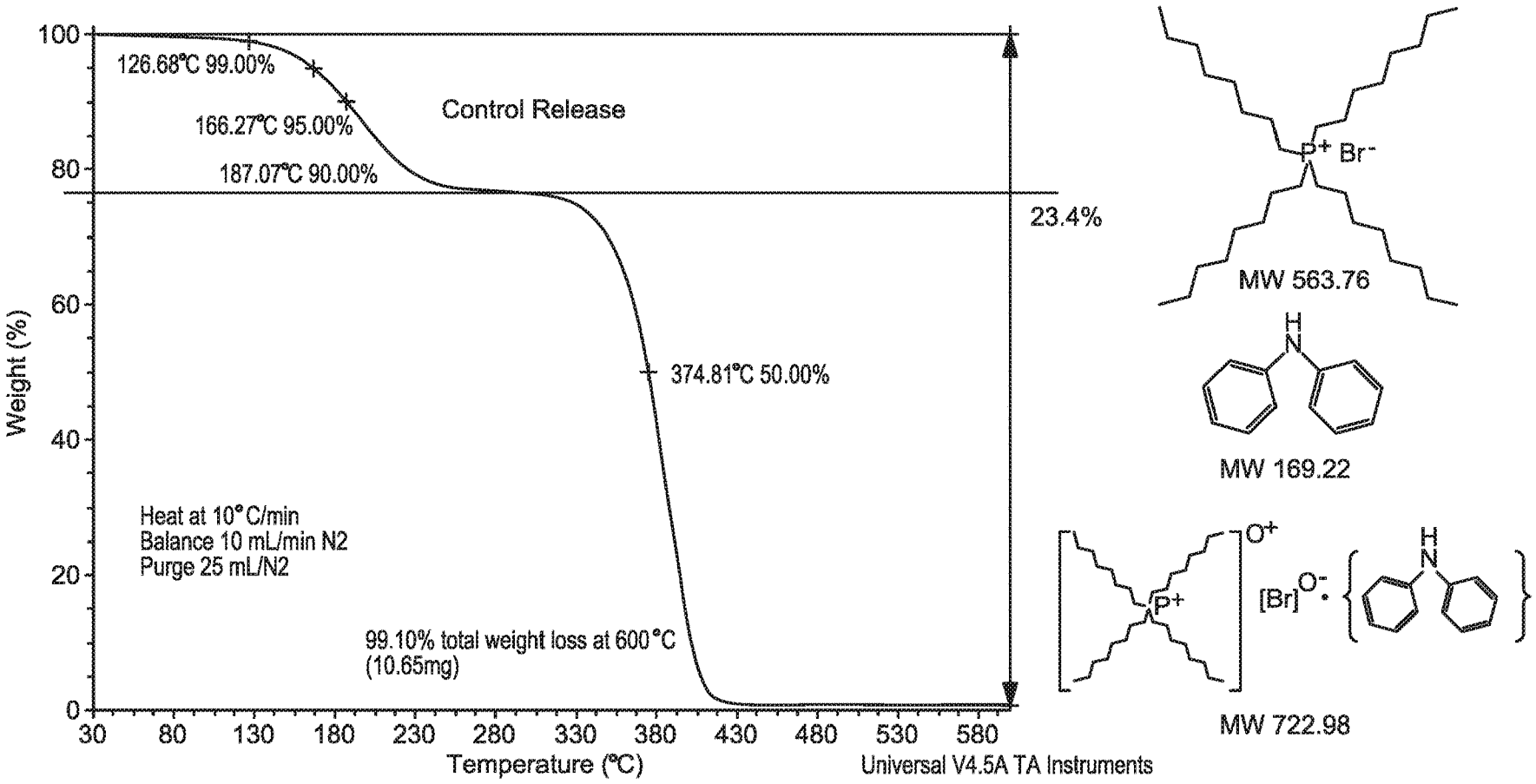
FIG. 3 shows thermogravimetric analysis (TGA) analysis of the resultant liquid prepared in Example 1 of this disclosure.

All numerical values within the detailed description and the claims herein are modified by "about" or "approximately" the indicated value, and take into account experimental error and variations that would be expected by a person having ordinary skill in the art.

For purposes of this disclosure, LTTMs or DESs are used interchangeably and the fluid mixtures may show (eutectic) melting points or show glass transitions instead.

In an embodiment, this disclosure relates to LTTMs or DESs that are useful as synthetic base stocks and/or as lubricant additives for lubricant compositions. This disclosure relates to liquid, substantially anhydrous eutectic mixtures comprising at least two components that can be used as synthetic base stocks, co-base stocks, functional fluids and/or lubricant additives.

In an embodiment, this disclosure provides a method of making a eutectic mixture that involves heating a component having the lowest melting point to the temperature at which it melts, dissolving the remaining component or components in the melted component, and allowing the mixture to cool. The mixtures of the disclosure are referred to as "eutectic mixtures" which for purposes of the present disclosure means an equilibrium phase between two or more components, which equilibrium phase, or mixture, does not have any of the physical characteristics of the individual components. Eutectic mixtures have not previously been used as synthetic base stock or as additives in lubes.

In accordance with this disclosure, the components of the mixture are all solid at room temperature prior to creation of the eutectic mixture, but after melting and dissolution of the components, an anhydrous solution results which remains liquid at room temperature without crystallization of the individual components. This is all achieved, in most cases, in the absence of any additional solvent that dissolves both compounds. To be successfully combined, the individual components must be compatible, i.e., each compound must form an intermolecular interaction with the other, so that this interaction will counteract the usual forces that tend to arrange the individual components into their individual crystalline forms. This result is only obtainable, however, when the components are mixed on the molecular level. In the present mixtures, while not wishing to be bound by any particular theory, it is believed that a complex forms between the two or more components, due to hydrogen bonds, or Van der Waals interactions, between the solutes, interfering with each compound's ability to recrystallize, i.e., to return to the solid state, thereby resulting in a liquid mixture of two normally solid compounds at room temperature.

The lube acceptable eutectic mixtures of this disclosure can be prepared under defined conditions. The mixtures of the disclosure can also provide for delivery of potential additives in a controlled fashion or controlled release manner that has limited solubility in lubes. The delivery can be triggered, for example, by either heat, moisture, or other solvent. These liquid fluids can potentially overcome some of the limitations ILs such as their potential toxicity, high cost and difficulties in getting fluids in high purity. These mixtures may have the advantage of being inexpensive, and easy to prepare from natural and readily available starting materials.

In a comparison of ILs with LTTMs and DESs, the ILs are ionic compounds while LTTMs/DESs are mixtures. In ILs the crystallization is avoided via the choice of unsymmetrical organic cations and anions; whereas in DESs/LTTMs it is hydrogen bonding or van der Waals forces that interfere with the ability of the initial compounds to crystallize. Limitations of ILs include, for example, potential toxicity, high cost and difficulties in getting IL fluids in high purity. DESs/LTTMs have advantage of being inexpensive, easy to prepare from natural materials, and readily available starting materials.

This disclosure deals with use of eutectic mixtures (LTTMs and DESs) as synthetic base stocks and/or as lubricant additives for lubricant compositions. This disclosure relates to a liquid, substantially anhydrous eutectic mixtures comprising at least two components that can be used as synthetic base stocks, co-base stocks, functional fluids, and/or lubricant additives. As used herein, the eutectic mixtures are also called LTTMs or DESs.

Illustrative advantages of the LTTMs and DESs of this disclosure include, for example, inexpensive and easy preparation, renewable and biodegradable, wide liquid range, low or negligible vapor pressure, good solvation properties, ability to customize properties as a function of constituents nature and ratio and conditions applied, and easy recovery using an anti-solvent.

The compositions of this disclosure possess low viscosity, low Noack volatility, and low temperature properties. The compositions of this disclosure exhibit desirable bulk flow properties.

As indicated above, the compositions of this disclosure comprise a eutectic mixture of at least a first component and at least a second component. The at least first component comprises a hydrogen bond acceptor and the at least second component comprises a hydrogen bond donor. The eutectic mixture comprises an equilibrium phase between the at least first component and the at least second component, and the equilibrium phase does not exhibit physical characteristics of the at least first component in an unmixed state and the at least second component in an unmixed state. The at least first component and the at least second component form an intermolecular interaction between each other sufficient to prevent crystallization of the at least first component and the at least second component in the eutectic mixture. The eutectic mixture is a liquid at 20° C.

The compositions of this disclosure have a kinematic viscosity at a temperature of 100° C. ($Kv_{100}$), measured according to ASTM standard D-445, from about 2 to about 300 cst, preferably from about 2.1 to about 250 cst, and more preferably from about 2.2 to about 200 cst.

The compositions of this disclosure have a kinematic viscosity at a temperature of 40° C. ($Kv_{40}$), measured according to ASTM standard D-445, from about 5 to about 4000 cst, preferably from about 10 to about 3000 cst, and more preferably from about 20 to about 2000 cst.

The compositions of this disclosure have a viscosity index (VI), measured according to ASTM standard D-2270, from about −100 to about 300, preferably from about 0 to about 280, and more preferably from about 50 to about 250.

The compositions of this disclosure have a Noack volatility of no greater than 90 percent, preferably no greater than 80 percent, and more preferably no greater than about 50 percent. As used herein, Noack volatility is determined by ASTM D-5800.

In the eutectic mixtures of this disclosure, the at least first component comprises a hydrogen bond acceptor. The at least first component should be capable of forming an intermolecular interaction with the at least second component sufficient to prevent crystallization of the at least first component and the at least second component in the eutectic mixture.

Illustrative hydrogen bond acceptors include, for example, amino acids, salts including organic salts and natural salts, and the like.

In particular, illustrative hydrogen bond acceptors include, for example, tetraoctylphosphonium bromide, (2-hydroxyethyl)trimethylammonium chloride (choline), 1-ethyl-3-methylimidazolium bromide, tributyldodecylphosphonium bromide, tetrahexylammonium chloride, ethylammonium chloride, tetramethylammonium chloride, alanine, betaine, glycine, histidine, proline, ethyl(2-hydroxyethyl)-dimethylammonium chloride, chloline nitrate, trimethylammonium chloride, triethylammonium bromide, chloline tetrafluoroborate, chlorochloline chloride, 2-fluoroethyl-trimethylammonium bromide, acetylchloline chloride, choline fluoride, benzyldimethyl(2-hydroxyethyl)-ammonium chloride, diethyl(2-hydroethyl)-ammonium chloride, lidocaine, tetrabutylammonium chloride, (phenylmethyl)triphenyl phosphonium chloride, methyltriphenylphosphonium bromide, tributyloctylphosphonium bromide, 1-ethyl-3-methylimidazolium chloride, tetraoctylammonium bromide, methyltrioctylammonium bromide, 1-butyl-3-methylimidazolium chloride, tetrabutylphosphonium methanesulfonate, (2-hydroxyethyl)benzyldimethylammonium chloride, trihexyltetradecylphosphonium chloride, trihexyltetradecylphosphonium bromide, (2-chloroethyl)trimethylammonium chloride, (2-chloroethyl)trimethylammonium bromide, (2-acetoxy)trimethylammonium chloride, and the like.

In the eutectic mixtures of this disclosure, the at least second component comprises a hydrogen bond donor. The at least second component should be capable of forming an intermolecular interaction with the at least first component sufficient to prevent crystallization of the at least first component and the at least second component in the eutectic mixture.

Illustrative hydrogen bond donors include, for example, organic acids, alcohols, polyols, aldehydes, carbohydrates, saccharides, and the like.

In particular, illustrative hydrogen bond donors include, for example, lactic acid, malic acid, oxalic acid (anhydrous or dihydrate), nicotinic acid, acetamide, malonic acid, xylitol, urea, 1,2-dimethylurea, D-isosorbide, tartatic acid, tricarballylic acid, thiourea, trifluoroacetamide, benzoic acid, itaconic acid, citric acid, imidazole, 2-imidazolinone, benzamide, 4-hydroxybenzoic acid, cinnamic acid, ethylene glycol, propylene urea, resorcinol, phenylacetic acid, D-sorbitol, 1,3-dimethylurea, levulinic acid, gallic acid, caffeic acid, 1-methylurea, glycerol, succinic acid, hexanoic acid, coumaric acid, stearic acid, oleic acid, linoleic acid, adipic acid, suberic acid, decanoic acid, trichloroacetic acid, phenlyacetic acid, p-toluene sulfonic acid, cresol, phenol, ethylene glycol, glycerol, fructose, phenothiazine, and the like.

The compositions of this disclosure (e.g., LTTMs or DESs) include, for example, mixtures of salts with organic acids or amino acids (e.g., choline chloride+malic acid), mixtures of organic acids with amino acids (e.g., proline+malic acid), mixtures of salts with alcohols or aldehydes (e.g., choline chloride+glycerol), and mixtures of organic acids or amino acids with alcohols, carbohydrates or aldehydes (e.g., fructose+glucose+malic acid).

In an embodiment, the at least first component in an unmixed state is a solid at 20° C. and the at least second component in an unmixed state is a solid at 20° C. The intermolecular interaction between the at least first component and the at least second component comprises hydrogen bonding or Van der Waals force. The eutectic mixtures of this disclosure are essentially anhydrous.

The compositions of this disclosure are useful, for example, as a synthetic base stock, a synthetic co-base stock, a functional fluid, or a lubricant additive.

The compositions of this disclosure can be prepared by a process that involves providing at least a first component and at least a second component. The at least first component and the at least second component are solids at 20° C. The process further involves heating either the at least first component or the at least second component, whichever has the lowest melting point, at a temperature sufficient to melt either the at least first component or the at least second component having the lowest melting point. The process yet further involves dissolving either the at least first component or the at least second component, whichever does not have the lowest melting point, in either the melted at least first component or the melted at least second component, to form a eutectic mixture.

The eutectic mixtures prepared by the process of this disclosure contain an equilibrium phase between the at least first component and the at least second component, and the equilibrium phase does not exhibit physical characteristics of the at least first component and the at least second component. The at least first component and the at least second component form an intermolecular interaction between each other sufficient to prevent crystallization of the at least first component and the at least second component in the eutectic mixture. The eutectic mixtures prepared by the processes of this disclosure are liquid at 20° C.

In accordance with this disclosure, the at least first component and the at least second component are mixed at the molecular level. This allows the at least first component and the at least second component to form intermolecular interactions with each other. The intermolecular interactions counteract the usual forces that tend to arrange the individual components into their individual crystalline forms.

Suitable at least first components and at least second components useful in this disclosure are described herein.

Process conditions for the preparation of the eutectic mixtures of this disclosure, such as temperature, pressure and contact time, may also vary greatly and any suitable combination of such conditions may be employed herein. The reaction temperature may range between about −10° C. to about 250° C., and preferably between about 0° C. to about 200° C., and more preferably between about 25° C. to about 150° C. Normally the reaction is carried out under ambient pressure and the contact time may vary from a matter of seconds or minutes to a few hours or greater. The reactants can be added to the reaction mixture or combined in any order. The stir time employed can range from about 0.5 to about 72 hours, preferably from about 1 to 36 hours, and more preferably from about 2 to 24 hours.

Examples of techniques that can be employed to characterize the compositions formed by the process described above include, but are not limited to, analytical gas chromatography, FTIR spectroscopy, nuclear magnetic resonance, thermogravimetric analysis (TGA), inductively coupled plasma mass spectrometry, differential scanning calorimetry (DSC), volatility and viscosity measurements.

This disclosure provides lubricating oils useful as engine oils and in other applications characterized by excellent solvency and dispersancy characteristics. The lubricating oils are based on high quality base stocks including a major portion of a hydrocarbon base fluid such as a PAO with a secondary co-base stock component which is a eutectic mixture as described herein. The lubricating oil base stock can be any oil boiling in the lube oil boiling range, typically between about 100 to 450° C. In the present specification and claims, the terms base oil(s) and base stock(s) are used interchangeably.

The viscosity-temperature relationship of a lubricating oil is one of the critical criteria which must be considered when selecting a lubricant for a particular application. Viscosity Index (VI) is an empirical, unitless number which indicates the rate of change in the viscosity of an oil within a given temperature range. Fluids exhibiting a relatively large change in viscosity with temperature are said to have a low viscosity index. A low VI oil, for example, will thin out at elevated temperatures faster than a high VI oil. Usually, the high VI oil is more desirable because it has higher viscosity at higher temperature, which translates into better or thicker lubrication film and better protection of the contacting machine elements.

In another aspect, as the oil operating temperature decreases, the viscosity of a high VI oil will not increase as much as the viscosity of a low VI oil. This is advantageous because the excessive high viscosity of the low VI oil will decrease the efficiency of the operating machine. Thus high VI (HVI) oil has performance advantages in both high and low temperature operation. VI is determined according to ASTM method D 2270-93 [1998]. VI is related to kinematic viscosities measured at 40° C. and 100° C. using ASTM Method D 445-01.

In another embodiment, wear control is improved, friction is reduced, and fuel efficiency is maintained or improved as compared to wear control, friction reduction and fuel efficiency achieved using a lubricating engine oil containing a co-base stock other than the eutectic mixture co-base stock.

Lubricating Oil Base Stocks

A wide range of lubricating base oils is known in the art. Lubricating base oils that are useful in the present disclosure are natural oils, mineral oils and synthetic oils, and unconventional oils (or mixtures thereof) can be used unrefined, refined, or rerefined (the latter is also known as reclaimed or reprocessed oil). Unrefined oils are those obtained directly from a natural or synthetic source and used without added purification. These include shale oil obtained directly from retorting operations, petroleum oil obtained directly from primary distillation, and ester oil obtained directly from an esterification process. Refined oils are similar to the oils discussed for unrefined oils except refined oils are subjected to one or more purification steps to improve at least one lubricating oil property. One skilled in the art is familiar with many purification processes. These processes include solvent extraction, secondary distillation, acid extraction, base extraction, filtration, and percolation. Rerefined oils are obtained by processes analogous to refined oils but using an oil that has been previously used as a feed stock.

Groups I, II, III, IV and V are broad base oil stock categories developed and defined by the American Petroleum Institute (API Publication 1509; www.API.org) to create guidelines for lubricant base oils. Group I base stocks have a viscosity index of between about 80 to 120 and contain greater than about 0.03% sulfur and/or less than about 90% saturates. Group II base stocks have a viscosity index of between about 80 to 120, and contain less than or equal to about 0.03% sulfur and greater than or equal to about 90% saturates. Group III stocks have a viscosity index greater than about 120 and contain less than or equal to about 0.03% sulfur and greater than about 90% saturates. Group IV includes polyalphaolefins (PAO). Group V base stock includes base stocks not included in Groups I-IV. The table below summarizes properties of each of these five groups.

| | Base Oil Properties | | |
|---|---|---|---|
| | Saturates | Sulfur | Viscosity Index |
| Group I | <90 and/or | >0.03% and | ≥80 and <120 |
| Group II | ≥90 and | ≤0.03% and | ≥80 and <120 |
| Group III | ≥90 and | ≤0.03% and | ≥120 |
| Group IV | polyalphaolefins (PAO) | | |
| Group V | All other base oil stocks not included in Groups I, II, III or IV | | |

Natural oils include animal oils, vegetable oils (castor oil and lard oil, for example), and mineral oils. Animal and vegetable oils possessing favorable thermal oxidative stability can be used. Of the natural oils, mineral oils are preferred. Mineral oils vary widely as to their crude source, for example, as to whether they are paraffinic, naphthenic, or mixed paraffinic-naphthenic. Oils derived from coal or shale are also useful. Natural oils vary also as to the method used for their production and purification, for example, their distillation range and whether they are straight run or cracked, hydrorefined, or solvent extracted.

Group II and/or Group III hydroprocessed or hydrocracked base stocks, including synthetic oils such as alkyl aromatics and synthetic esters are also well known base stock oils.

Synthetic oils include hydrocarbon oil. Hydrocarbon oils include oils such as polymerized and interpolymerized olefins (polybutylenes, polypropylenes, propylene isobutylene copolymers, ethylene-olefin copolymers, and ethylene-alphaolefin copolymers, for example). Polyalphaolefin (PAO) oil base stocks are commonly used synthetic hydrocarbon oil. By way of example, PAOs derived from $C_8$, $C_{10}$, $C_{12}$, $C_{14}$ olefins or mixtures thereof may be utilized. See U.S. Pat. Nos. 4,956,122; 4,827,064; and 4,827,073.

The number average molecular weights of the PAOs, which are known materials and generally available on a major commercial scale from suppliers such as ExxonMobil Chemical Company, Chevron Phillips Chemical Company, BP, and others, typically vary from about 250 to about 3,000, although PAO's may be made in viscosities up to about 150 cSt (100° C.). The PAOs are typically comprised of relatively low molecular weight hydrogenated polymers or oligomers of alphaolefins which include, but are not limited to, $C_2$ to about $C_{32}$ alphaolefins with the $C_8$ to about $C_{16}$ alphaolefins, such as 1-octene, 1-decene, 1-dodecene and the like, being preferred. The preferred polyalphaolefins are poly-1-octene, poly-1-decene and poly-1-dodecene and mixtures thereof and mixed olefin-derived polyolefins. However, the dimers of higher olefins in the range of $C_{14}$ to $C_{18}$ may be used to provide low viscosity base stocks of acceptably low volatility. Depending on the viscosity grade and the starting oligomer, the PAOs may be predominantly trimers and tetramers of the starting olefins, with minor amounts of the higher oligomers, having a viscosity range of 1.5 to 12 cSt. PAO fluids of particular use may include 3.0 cSt, 3.4 cSt, and/or 3.6 cSt and combinations thereof. Mixtures of PAO fluids having a viscosity range of 1.5 to approximately 150 cSt or more may be used if desired.

The PAO fluids may be conveniently made by the polymerization of an alphaolefin in the presence of a polymerization catalyst such as the Friedel-Crafts catalysts including, for example, aluminum trichloride, boron trifluoride or complexes of boron trifluoride with water, alcohols such as ethanol, propanol or butanol, carboxylic acids or esters such as ethyl acetate or ethyl propionate. For example the methods disclosed by U.S. Pat. No. 4,149,178 or 3,382,291 may be conveniently used herein. Other descriptions of PAO synthesis are found in the following U.S. Pat. Nos. 3,742,082; 3,769,363; 3,876,720; 4,239,930; 4,367,352; 4,413,156; 4,434,408; 4,910,355; 4,956,122; and 5,068,487. The dimers of the $C_{14}$ to $C_{18}$ olefins are described in U.S. Pat. No. 4,218,330.

Other useful lubricant oil base stocks include wax isomerate base stocks and base oils, comprising hydroisomerized waxy stocks (e.g. waxy stocks such as gas oils, slack waxes, fuels hydrocracker bottoms, etc.), hydroisomerized Fischer-Tropsch waxes, Gas-to-Liquids (GTL) base stocks and base oils, and other wax isomerate hydroisomerized base stocks and base oils, or mixtures thereof. Fischer-Tropsch waxes, the high boiling point residues of Fischer-Tropsch synthesis, are highly paraffinic hydrocarbons with very low sulfur content. The hydroprocessing used for the production of such base stocks may use an amorphous hydrocracking/hydroisomerization catalyst, such as one of the specialized lube hydrocracking (LHDC) catalysts or a crystalline hydrocracking/hydroisomerization catalyst, preferably a zeolitic catalyst. For example, one useful catalyst is ZSM-48 as described in U.S. Pat. No. 5,075,269, the disclosure of which is incorporated herein by reference in its entirety. Processes for making hydrocracked/hydroisomerized distillates and hydrocracked/hydroisomerized waxes are described, for example, in U.S. Pat. Nos. 2,817,693; 4,975,177; 4,921,594 and 4,897,178 as well as in British Patent Nos. 1,429,494; 1,350,257; 1,440,230 and 1,390,359. Each of the aforementioned patents is incorporated herein in their entirety. Particularly favorable processes are described in European Patent Application Nos. 464546 and 464547, also incorporated herein by reference. Processes using Fischer-Tropsch wax feeds are described in U.S. Pat. Nos. 4,594,172 and 4,943,672, the disclosures of which are incorporated herein by reference in their entirety.

Gas-to-Liquids (GTL) base oils, Fischer-Tropsch wax derived base oils, and other wax-derived hydroisomerized (wax isomerate) base oils be advantageously used in the instant disclosure, and may have useful kinematic viscosities at 100° C. of about 3 cSt to about 50 cSt, preferably about 3 cSt to about 30 cSt, more preferably about 3.5 cSt to about 25 cSt, as exemplified by GTL 4 with kinematic viscosity of about 4.0 cSt at 100° C. and a viscosity index of about 141. These Gas-to-Liquids (GTL) base oils, Fischer-Tropsch wax derived base oils, and other wax-derived hydroisomerized base oils may have useful pour points of about −20° C. or lower, and under some conditions may have advantageous pour points of about −25° C. or lower, with useful pour points of about −30° C. to about −40° C. or lower. Useful compositions of Gas-to-Liquids (GTL) base oils, Fischer-Tropsch wax derived base oils, and wax-derived hydroisomerized base oils are recited in U.S. Pat. Nos. 6,080,301; 6,090,989, and 6,165,949 for example, and are incorporated herein in their entirety by reference.

The hydrocarbyl aromatics can be used as a base oil or base oil component and can be any hydrocarbyl molecule that contains at least about 5% of its weight derived from an aromatic moiety such as a benzenoid moiety or naphthenoid moiety, or their derivatives. These hydrocarbyl aromatics include alkyl benzenes, alkyl naphthalenes, alkyl diphenyl oxides, alkyl naphthols, alkyl diphenyl sulfides, alkylated bis-phenol A, alkylated thiodiphenol, and the like. The aromatic can be mono-alkylated, dialkylated, polyalkylated, and the like. The aromatic can be mono- or poly-functionalized. The hydrocarbyl groups can also be comprised of mixtures of alkyl groups, alkenyl groups, alkynyl, cycloalkyl groups, cycloalkenyl groups and other related hydrocarbyl groups. The hydrocarbyl groups can range from about $C_6$ up to about $C_{60}$ with a range of about $C_8$ to about $C_{20}$ often being preferred. A mixture of hydrocarbyl groups is often preferred, and up to about three such substituents may be present. The hydrocarbyl group can optionally contain sulfur, oxygen, and/or nitrogen containing substituents. The aromatic group can also be derived from natural (petroleum) sources, provided at least about 5% of the molecule is comprised of an above-type aromatic moiety. Viscosities at 100° C. of approximately 3 cSt to about 50 cSt are preferred, with viscosities of approximately 3.4 cSt to about 20 cSt often being more preferred for the hydrocarbyl aromatic component. In one embodiment, an alkyl naphthalene where the alkyl group is primarily comprised of 1-hexadecene is used. Other alkylates of aromatics can be advantageously used. Naphthalene or methyl naphthalene, for example, can be alkylated with olefins such as octene, decene, dodecene, tetradecene or higher, mixtures of similar olefins, and the like. Useful concentrations of hydrocarbyl aromatic in a lubricant oil composition can be about 2% to about 25%, preferably about 4% to about 20%, and more preferably about 4% to about 15%, depending on the application.

Alkylated aromatics such as the hydrocarbyl aromatics of the present disclosure may be produced by well-known Friedel-Crafts alkylation of aromatic compounds. See Friedel-Crafts and Related Reactions, Olah, G. A. (ed.), Interscience Publishers, New York, 1963. For example, an aromatic compound, such as benzene or naphthalene, is alkylated by an olefin, alkyl halide or alcohol in the presence of a Friedel-Crafts catalyst. See Friedel-Crafts and Related Reactions, Vol. 2, part 1, chapters 14, 17, and 18, See Olah, G. A. (ed.), Inter-science Publishers, New York, 1964. Many homogeneous or heterogeneous, solid catalysts are known to one skilled in the art. The choice of catalyst depends on the reactivity of the starting materials and product quality requirements. For example, strong acids such as $AlCl_3$, $BF_3$, or HF may be used. In some cases, milder catalysts such as $FeCl_3$ or $SnCl_4$ are preferred. Newer alkylation technology uses zeolites or solid super acids.

Esters comprise a useful base stock. Additive solvency and seal compatibility characteristics may be secured by the use of esters such as the esters of dibasic acids with monoalkanols and the polyol esters of monocarboxylic acids. Esters of the former type include, for example, the esters of dicarboxylic acids such as phthalic acid, succinic acid, alkyl succinic acid, alkenyl succinic acid, maleic acid, azelaic acid, suberic acid, sebacic acid, fumaric acid, adipic acid, linoleic acid dimer, malonic acid, alkyl malonic acid, alkenyl malonic acid, etc., with a variety of alcohols such as butyl alcohol, hexyl alcohol, dodecyl alcohol, 2-ethylhexyl alcohol, etc. Specific examples of these types of esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, etc.

Particularly useful synthetic esters are those which are obtained by reacting one or more polyhydric alcohols, preferably the hindered polyols (such as the neopentyl polyols, e.g., neopentyl glycol, trimethylol ethane, 2-methyl-2-propyl-1,3-propanediol, trimethylol propane, pentaerythritol and dipentaerythritol) with alkanoic acids containing at least about 4 carbon atoms, preferably $C_5$ to $C_{30}$ acids such as saturated straight chain fatty acids including caprylic acid, capric acid, lauric acid, myristic acid, palmitic acid, stearic acid, arachic acid, and behenic acid, or the corresponding branched chain fatty acids or unsaturated fatty acids such as oleic acid, or mixtures of any of these materials.

Suitable synthetic ester components include the esters of trimethylol propane, trimethylol butane, trimethylol ethane, pentaerythritol and/or dipentaerythritol with one or more monocarboxylic acids containing from about 5 to about 10 carbon atoms. These esters are widely available commercially, for example, the Mobil P-41 and P-51 esters of ExxonMobil Chemical Company.

Also useful are esters derived from renewable material such as coconut, palm, rapeseed, soy, sunflower and the like. These esters may be monoesters, di-esters, polyol esters, complex esters, or mixtures thereof. These esters are widely available commercially, for example, the Mobil P-51 ester of ExxonMobil Chemical Company.

Engine oil formulations containing renewable esters are included in this disclosure. For such formulations, the renewable content of the ester is typically greater than about 70 weight percent, preferably more than about 80 weight percent and most preferably more than about 90 weight percent.

Other useful fluids of lubricating viscosity include non-conventional or unconventional base stocks that have been processed, preferably catalytically, or synthesized to provide high performance lubrication characteristics.

Non-conventional or unconventional base stocks/base oils include one or more of a mixture of base stock(s) derived from one or more Gas-to-Liquids (GTL) materials, as well as isomerate/isodewaxate base stock(s) derived from natural wax or waxy feeds, mineral and or non-mineral oil waxy feed stocks such as slack waxes, natural waxes, and waxy stocks such as gas oils, waxy fuels hydrocracker bottoms, waxy raffinate, hydrocrackate, thermal crackates, or other mineral, mineral oil, or even non-petroleum oil derived waxy materials such as waxy materials received from coal liquefaction or shale oil, and mixtures of such base stocks.

GTL materials are materials that are derived via one or more synthesis, combination, transformation, rearrangement, and/or degradation/deconstructive processes from gaseous carbon-containing compounds, hydrogen-containing compounds and/or elements as feed stocks such as hydrogen, carbon dioxide, carbon monoxide, water, methane, ethane, ethylene, acetylene, propane, propylene, propyne, butane, butylenes, and butynes. GTL base stocks and/or base oils are GTL materials of lubricating viscosity that are generally derived from hydrocarbons; for example, waxy synthesized hydrocarbons, that are themselves derived from simpler gaseous carbon-containing compounds, hydrogen-containing compounds and/or elements as feed stocks. GTL base stock(s) and/or base oil(s) include oils boiling in the lube oil boiling range (1) separated/fractionated from synthesized GTL materials such as, for example, by distillation and subsequently subjected to a final wax processing step which involves either or both of a catalytic dewaxing process, or a solvent dewaxing process, to produce lube oils of reduced/low pour point; (2) synthesized wax isomerates, comprising, for example, hydrodewaxed or hydroisomerized cat and/or solvent dewaxed synthesized wax or waxy hydrocarbons; (3) hydrodewaxed or hydroisomerized cat and/or solvent dewaxed Fischer-Tropsch (F-T) material (i.e., hydrocarbons, waxy hydrocarbons, waxes and possible analogous oxygenates); preferably hydrodewaxed or hydroisomerized/followed by cat and/or solvent dewaxing dewaxed F-T waxy hydrocarbons, or hydrodewaxed or hydroisomerized/followed by cat (or solvent) dewaxing dewaxed, F-T waxes, or mixtures thereof.

GTL base stock(s) and/or base oil(s) derived from GTL materials, especially, hydrodewaxed or hydroisomerized/followed by cat and/or solvent dewaxed wax or waxy feed, preferably F-T material derived base stock(s) and/or base oil(s), are characterized typically as having kinematic viscosities at 100° C. of from about 2 $mm^2/s$ to about 50 $mm^2/s$ (ASTM D445). They are further characterized typically as having pour points of −5° C. to about −40° C. or lower (ASTM D97). They are also characterized typically as having viscosity indices of about 80 to about 140 or greater (ASTM D2270).

In addition, the GTL base stock(s) and/or base oil(s) are typically highly paraffinic (>90% saturates), and may contain mixtures of monocycloparaffins and multicycloparaffins in combination with non-cyclic isoparaffins. The ratio of the naphthenic (i.e., cycloparaffin) content in such combinations varies with the catalyst and temperature used. Further, GTL base stock(s) and/or base oil(s) typically have very low sulfur and nitrogen content, generally containing less than about 10 ppm, and more typically less than about 5 ppm of each of these elements. The sulfur and nitrogen content of GTL base stock(s) and/or base oil(s) obtained from F-T material, especially F-T wax, is essentially nil. In addition, the absence of phosphorous and aromatics make this materially especially suitable for the formulation of low SAP products.

The term GTL base stock and/or base oil and/or wax isomerate base stock and/or base oil is to be understood as embracing individual fractions of such materials of wide viscosity range as recovered in the production process, mixtures of two or more of such fractions, as well as mixtures of one or two or more low viscosity fractions with one, two or more higher viscosity fractions to produce a blend wherein the blend exhibits a target kinematic viscosity.

The GTL material, from which the GTL base stock(s) and/or base oil(s) is/are derived is preferably an F-T material (i.e., hydrocarbons, waxy hydrocarbons, wax).

Base oils for use in the formulated lubricating oils useful in the present disclosure are any of the variety of oils corresponding to API Group I, Group II, Group III, Group IV, and Group V oils and mixtures thereof, preferably API Group II, Group III, Group IV, and Group V oils and mixtures thereof, more preferably the Group III to Group V base oils due to their exceptional volatility, stability, viscometric and cleanliness features. Minor quantities of Group I stock, such as the amount used to dilute additives for blending into formulated lube oil products, can be tolerated but should be kept to a minimum, i.e. amounts only associated with their use as diluent/carrier oil for additives used on an "as-received" basis. Even in regard to the Group II stocks, it is preferred that the Group II stock be in the higher quality range associated with that stock, i.e. a Group II stock having a viscosity index in the range 100<VI<120.

The base oil constitutes the major component of the engine oil lubricant composition of the present disclosure and typically is present in an amount ranging from about 50 to about 99 weight percent, preferably from about 70 to about 95 weight percent, and more preferably from about 85 to about 95 weight percent, based on the total weight of the composition. The base oil may be selected from any of the synthetic or natural oils typically used as crankcase lubricating oils for spark-ignited and compression-ignited engines. The base oil conveniently has a kinematic viscosity, according to ASTM standards, of about 2.5 cSt to about 12 cSt (or $mm^2/s$) at 100° C. and preferably of about 2.5 cSt to about 9 cSt (or $mm^2/s$) at 100° C. Mixtures of synthetic and natural base oils may be used if desired. Bi-modal mixtures of Group I, II, III, IV, and/or V base stocks may be used if desired.

Co-Base Stock Components

Eutectic mixture co-base stock components useful in this disclosure include, for example, compositions containing a eutectic mixture of at least a first component and at least a second component. The eutectic mixture comprises an equilibrium phase between the at least first component and the at least second component, and the equilibrium phase does not exhibit physical characteristics of the at least first component in an unmixed state and the at least second component in an unmixed state. The at least first component and the at least second component form an intermolecular interaction between each other sufficient to prevent crystallization of the at least first component and the at least second component in the eutectic mixture. The eutectic mixture is a liquid at 20° C.

The eutectic mixture co-base stock components of this disclosure have a kinematic viscosity at a temperature of 100° C. ($Kv_{100}$), measured according to ASTM standard D-445, from about 2 to about 300 cst, preferably from about 2.1 to about 250 cst, and more preferably from about 2.2 to about 200 cst.

The eutectic mixture co-base stock components of this disclosure have a kinematic viscosity at a temperature of 40° C. ($Kv_{40}$), measured according to ASTM standard D-445, from about 5 to about 4000 cst, preferably from about 10 to about 3000 cst, and more preferably from about 20 to about 2000 cst.

The eutectic mixture co-base stock components of this disclosure have a viscosity index (VI), measured according to ASTM standard D-2270, from about −100 to about 300, preferably from about 0 to about 280, and more preferably from about 50 to about 250.

The eutectic mixture co-base stock components of this disclosure have a Noack volatility of no greater than 90 percent, preferably no greater than 80 percent, and more preferably no greater than about 50 percent. As used herein, Noack volatility is determined by ASTM D-5800.

In the eutectic mixture co-base stock components of this disclosure, the at least first component comprises an organic salt. The at least first component should be capable of forming an intermolecular interaction with the at least second component sufficient to prevent crystallization of the at least first component and the at least second component in the eutectic mixture.

In the eutectic mixtures of this disclosure, the at least second component comprises an organic amine, an organic acid, or a polyol. The at least second component should be capable of forming an intermolecular interaction with the at least first component sufficient to prevent crystallization of the at least first component and the at least second component in the eutectic mixture.

Illustrative organic salts, organic amines, organic acids, and polyols are described herein.

Methods for the production of eutectic mixture co-base stock components suitable for use in the present disclosure are described herein.

In an embodiment, the at least first component in an unmixed state is a solid at 20° C. and the at least second component in an unmixed state is a solid at 20° C. The intermolecular interaction between the at least first component and the at least second component comprises hydrogen bonding or Van der Waals force. The eutectic mixtures of this disclosure are essentially anhydrous.

The eutectic mixture co-base stock component is present in the lubricating oils of this disclosure in an amount from about 1 to about 50 weight percent, preferably from about 5 to about 30 weight percent, and more preferably from about 10 to about 20 weight percent.

Other Additives

The formulated lubricating oil useful in the present disclosure may additionally contain one or more of the other commonly used lubricating oil performance additives including but not limited to detergents, anti-wear additives, dispersants, viscosity modifiers, corrosion inhibitors, rust inhibitors, metal deactivators, extreme pressure additives, anti-seizure agents, wax modifiers, viscosity modifiers, fluid-loss additives, seal compatibility agents, lubricity agents, anti-staining agents, chromophoric agents, defoamants, demulsifiers, emulsifiers, densifiers, wetting agents, gelling agents, tackiness agents, colorants, and others. For a review of many commonly used additives, see Klamann in Lubricants and Related Products, Verlag Chemie, Deerfield Beach, Fla.; ISBN 0-89573-177-0. Reference is also made to "Lubricant Additives" by M. W. Ranney, published by Noyes Data Corporation of Parkridge, N J (1973); see also U.S. Pat. No. 7,704,930, the disclosure of which is incorporated herein in its entirety. These additives are commonly delivered with varying amounts of diluent oil, that may range from 5 weight percent to 50 weight percent.

The additives useful in this disclosure do not have to be soluble in the lubricating oils. Insoluble additives such as zinc stearate in oil can be dispersed in the lubricating oils of this disclosure.

The types and quantities of performance additives used in combination with the instant disclosure in lubricant compositions are not limited by the examples shown herein as illustrations.

Detergents

Illustrative detergents useful in this disclosure include, for example, alkali metal detergents, alkaline earth metal detergents, or mixtures of one or more alkali metal detergents and one or more alkaline earth metal detergents. A typical detergent is an anionic material that contains a long chain hydrophobic portion of the molecule and a smaller anionic or oleophobic hydrophilic portion of the molecule. The anionic portion of the detergent is typically derived from an organic acid such as a sulfur acid, carboxylic acid (e.g., salicylic acid), phosphorous acid, phenol, or mixtures thereof. The counterion is typically an alkaline earth or alkali metal.

The detergent is preferably a metal salt of an organic or inorganic acid, a metal salt of a phenol, or mixtures thereof. The metal is preferably selected from an alkali metal, an alkaline earth metal, and mixtures thereof. The organic or inorganic acid is selected from an aliphatic organic or inorganic acid, a cycloaliphatic organic or inorganic acid, an aromatic organic or inorganic acid, and mixtures thereof.

The metal is preferably selected from an alkali metal, an alkaline earth metal, and mixtures thereof. More preferably, the metal is selected from calcium (Ca), magnesium (Mg), and mixtures thereof.

The organic acid or inorganic acid is preferably selected from a sulfur acid, a carboxylic acid, a phosphorus acid, and mixtures thereof.

Preferably, the metal salt of an organic or inorganic acid or the metal salt of a phenol comprises calcium phenate, calcium sulfonate, calcium salicylate, magnesium phenate, magnesium sulfonate, magnesium salicylate, and mixtures thereof.

Alkaline earth phenates are another useful class of detergent. These detergents can be made by reacting alkaline earth metal hydroxide or oxide (CaO, $Ca(OH)_2$, BaO, $Ba(OH)_2$, MgO, $Mg(OH)_2$, for example) with an alkyl phenol or sulfurized alkylphenol. Useful alkyl groups include straight chain or branched $C_1$-$C_{30}$ alkyl groups, preferably, $C_4$-$C_{20}$ or mixtures thereof. Examples of suitable phenols include isobutylphenol, 2-ethylhexylphenol, nonylphenol, dodecyl phenol, and the like. It should be noted that starting alkylphenols may contain more than one alkyl substituent that are each independently straight chain or branched and can be used from 0.5 to 6 weight percent. When a non-sulfurized alkylphenol is used, the sulfurized product may be obtained by methods well known in the art. These methods include heating a mixture of alkylphenol and sulfurizing agent (including elemental sulfur, sulfur halides such as sulfur dichloride, and the like) and then reacting the sulfurized phenol with an alkaline earth metal base.

In accordance with this disclosure, metal salts of carboxylic acids are preferred detergents. These carboxylic acid detergents may be prepared by reacting a basic metal compound with at least one carboxylic acid and removing free water from the reaction product. Detergents made from salicylic acid are one preferred class of detergents derived from carboxylic acids. Useful salicylates include long chain alkyl salicylates. One useful family of compositions is of the formula

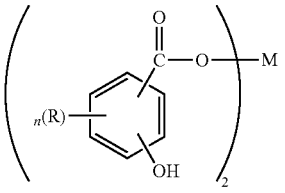

where R is an alkyl group having 1 to about 30 carbon atoms, n is an integer from 1 to 4, and M is an alkaline earth metal. Preferred R groups are alkyl chains of at least $C_{11}$, preferably $C_{13}$ or greater. R may be optionally substituted with substituents that do not interfere with the detergent's function. M is preferably, calcium, magnesium, or barium. More preferably, M is calcium.

Hydrocarbyl-substituted salicylic acids may be prepared from phenols by the Kolbe reaction (see U.S. Pat. No. 3,595,791). The metal salts of the hydrocarbyl-substituted salicylic acids may be prepared by double decomposition of a metal salt in a polar solvent such as water or alcohol.

Alkaline earth metal phosphates are also used as detergents and are known in the art.

Detergents may be simple detergents or what is known as hybrid or complex detergents. The latter detergents can provide the properties of two detergents without the need to blend separate materials. See U.S. Pat. No. 6,034,039.

Preferred detergents include calcium sulfonates, magnesium sulfonates, calcium salicylates, magnesium salicylates, calcium phenates, magnesium phenates, and other related components (including borated detergents), and mixtures thereof. Preferred mixtures of detergents include magnesium sulfonate and calcium salicylate, magnesium sulfonate and calcium sulfonate, magnesium sulfonate and calcium phenate, calcium phenate and calcium salicylate, calcium phenate and calcium sulfonate, calcium phenate and magnesium salicylate, calcium phenate and magnesium phenate.

The detergents can have total base number (TBN) ranging from neutral to highly overbased, i.e. TBN of 0 to over 500, preferably 2 to 400, more preferably 5 to 300.

The detergent concentration in the lubricating oils of this disclosure can range from about 0.5 to about 6.0 weight percent, preferably about 0.6 to 5.0 weight percent, and more preferably from about 0.8 weight percent to about 4.0 weight percent, based on the total weight of the lubricating oil.

As used herein, the detergent concentrations are given on an "as delivered" basis. Typically, the active detergent is delivered with a process oil. The "as delivered" detergent typically contains from about 20 weight percent to about 100 weight percent, or from about 40 weight percent to about 60 weight percent, of active detergent in the "as delivered" detergent product.

Antiwear Additives

Illustrative antiwear additives useful in this disclosure include, for example, metal salts of a carboxylic acid. The metal is selected from a transition metal and mixtures thereof. The carboxylic acid is selected from an aliphatic carboxylic acid, a cycloaliphatic carboxylic acid, an aromatic carboxylic acid, and mixtures thereof.

The metal is preferably selected from a Group 10, 11 and 12 metal, and mixtures thereof. The carboxylic acid is preferably an aliphatic, saturated, unbranched carboxylic acid having from about 8 to about 26 carbon atoms, and mixtures thereof.

The metal is preferably selected from nickel (Ni), palladium (Pd), platinum (Pt), copper (Cu), silver (Ag), gold (Au), zinc (Zn), cadium (Cd), mercury (Hg), and mixtures thereof.

The carboxylic acid is preferably selected from caprylic acid (C8), pelargonic acid (C9), capric acid (C10), undecylic acid (C11), lauric acid (C12), tridecylic acid (C13), myristic acid (C14), pentadecylic acid (C15), palmitic acid (C16), margaric acid (C17), stearic acid (C18), nonadecylic acid (C19), arachidic acid (C20), heneicosylic acid (C21), behenic acid (C22), tricosylic acid (C23), lignoceric acid (C24), pentacosylic acid (C25), cerotic acid (C26), and mixtures thereof.

Preferably, the metal salt of a carboxylic acid comprises zinc stearate, silver stearate, palladium stearate, zinc palmitate, silver palmitate, palladium palmitate, and mixtures thereof.

The metal salt of a carboxylic acid is present in the engine oil formulations of this disclosure in an amount of from about 0.01 weight percent to about 5 weight percent, based on the total weight of the formulated oil.

Low phosphorus engine oil formulations are included in this disclosure. For such formulations, the phosphorus content is typically less than about 0.12 weight percent preferably less than about 0.10 weight percent and most preferably less than about 0.085 weight percent.

A metal alkylthiophosphate and more particularly a metal dialkyl dithio phosphate in which the metal constituent is zinc, or zinc dialkyl dithio phosphate (ZDDP) can be a useful component of the lubricating oils of this disclosure. ZDDP can be derived from primary alcohols, secondary alcohols or mixtures thereof. ZDDP compounds generally are of the formula $$Zn[SP(S)(OR^1)(OR^2)]_2$$

where $R^1$ and $R^2$ are $C_1$-$C_{18}$ alkyl groups, preferably $C_2$-$C_{12}$ alkyl groups. These alkyl groups may be straight chain or branched. Alcohols used in the ZDDP can be 2-propanol, butanol, secondary butanol, pentanols, hexanols such as 4-methyl-2-pentanol, n-hexanol, n-octanol, 2-ethyl hexanol, alkylated phenols, and the like. Mixtures of secondary alcohols or of primary and secondary alcohol can be preferred. Alkyl aryl groups may also be used.

Preferable zinc dithiophosphates which are commercially available include secondary zinc dithiophosphates such as those available from for example, The Lubrizol Corporation under the trade designations "LZ 677A", "LZ 1095" and "LZ 1371", from for example Chevron Oronite under the trade designation "OLOA 262" and from for example Afton Chemical under the trade designation "HITEC 7169".

The ZDDP is typically used in amounts of from about 0.4 weight percent to about 1.2 weight percent, preferably from about 0.5 weight percent to about 1.0 weight percent, and more preferably from about 0.6 weight percent to about 0.8 weight percent, based on the total weight of the lubricating oil, although more or less can often be used advantageously. Preferably, the ZDDP is a secondary ZDDP and present in an amount of from about 0.6 to 1.0 weight percent of the total weight of the lubricating oil.

Low phosphorus engine oil formulations are included in this disclosure. For such formulations, the phosphorus content is typically less than about 0.12 weight percent preferably less than about 0.10 weight percent and most preferably less than about 0.085 weight percent.

Dispersants

During engine operation, oil-insoluble oxidation byproducts are produced. Dispersants help keep these byproducts in solution, thus diminishing their deposition on metal surfaces. Dispersants used in the formulation of the lubricating oil may be ashless or ash-forming in nature. Preferably, the dispersant is ashless. So called ashless dispersants are organic materials that form substantially no ash upon combustion. For example, non-metal-containing or borated metal-free dispersants are considered ashless. In contrast, metal-containing detergents discussed above form ash upon combustion.

Suitable dispersants typically contain a polar group attached to a relatively high molecular weight hydrocarbon chain. The polar group typically contains at least one element of nitrogen, oxygen, or phosphorus. Typical hydrocarbon chains contain 50 to 400 carbon atoms.

A particularly useful class of dispersants are the (poly) alkenylsuccinic derivatives, typically produced by the reaction of a long chain hydrocarbyl substituted succinic compound, usually a hydrocarbyl substituted succinic anhydride, with a polyhydroxy or polyamino compound. The long chain hydrocarbyl group constituting the oleophilic portion of the molecule which confers solubility in the oil, is normally a polyisobutylene group. Many examples of this type of dispersant are well known commercially and in the literature. Exemplary U.S. patents describing such dispersants are U.S. Pat. Nos. 3,172,892; 3,2145,707; 3,219,666; 3,316,177; 3,341,542; 3,444,170; 3,454,607; 3,541,012; 3,630,904; 3,632,511; 3,787,374 and 4,234,435. Other types of dispersant are described in U.S. Pat. Nos. 3,036,003; 3,200,107; 3,254,025; 3,275,554; 3,438,757; 3,454,555; 3,565,804; 3,413,347; 3,697,574; 3,725,277; 3,725,480; 3,726,882; 4,454,059; 3,329,658; 3,449,250; 3,519,565; 3,666,730; 3,687,849; 3,702,300; 4,100,082; 5,705,458. A further description of dispersants may be found, for example, in European Patent Application No. 471 071, to which reference is made for this purpose.

Hydrocarbyl-substituted succinic acid and hydrocarbyl-substituted succinic anhydride derivatives are useful dispersants. In particular, succinimide, succinate esters, or succinate ester amides prepared by the reaction of a hydrocarbon-substituted succinic acid compound preferably having at least 50 carbon atoms in the hydrocarbon substituent, with at least one equivalent of an alkylene amine are particularly useful.

Succinimides are formed by the condensation reaction between hydrocarbyl substituted succinic anhydrides and amines. Molar ratios can vary depending on the polyamine. For example, the molar ratio of hydrocarbyl substituted succinic anhydride to TEPA can vary from about 1:1 to about 5:1. Representative examples are shown in U.S. Pat. Nos. 3,087,936; 3,172,892; u) 3,219,666; 3,272,746; 3,322,670; and U.S. Pat. Nos. 3,652,616, 3,948,800; and Canada Patent No. 1,094,044.

Succinate esters are formed by the condensation reaction between hydrocarbyl substituted succinic anhydrides and alcohols or polyols. Molar ratios can vary depending on the alcohol or polyol used. For example, the condensation product of a hydrocarbyl substituted succinic anhydride and pentaerythritol is a useful dispersant.

Succinate ester amides are formed by condensation reaction between hydrocarbyl substituted succinic anhydrides and alkanol amines. For example, suitable alkanol amines include ethoxylated polyalkylpolyamines, propoxylated polyalkylpolyamines and polyalkenylpolyamines such as polyethylene polyamines. One example is propoxylated hexamethylenediamine Representative examples are shown in U.S. Pat. No. 4,426,305.

The molecular weight of the hydrocarbyl substituted succinic anhydrides used in the preceding paragraphs will typically range between 800 and 2,500 or more. The above products can be post-reacted with various reagents such as sulfur, oxygen, formaldehyde, carboxylic acids such as oleic acid. The above products can also be post reacted with boron compounds such as boric acid, borate esters or highly borated dispersants, to form borated dispersants generally having from about 0.1 to about 5 moles of boron per mole of dispersant reaction product.

Mannich base dispersants are made from the reaction of alkylphenols, formaldehyde, and amines. See U.S. Pat. No. 4,767,551, which is incorporated herein by reference. Process aids and catalysts, such as oleic acid and sulfonic acids, can also be part of the reaction mixture. Molecular weights of the alkylphenols range from 800 to 2,500. Representative examples are shown in U.S. Pat. Nos. 3,697,574; 3,703,536; 3,704,308; 3,751,365; 3,756,953; 3,798,165; and 3,803,039.

Typical high molecular weight aliphatic acid modified Mannich condensation products useful in this disclosure can be prepared from high molecular weight alkyl-substituted hydroxyaromatics or $HNR_2$ group-containing reactants.

Hydrocarbyl substituted amine ashless dispersant additives are well known to one skilled in the art; see, for example, U.S. Pat. Nos. 3,275,554; 3,438,757; 3,565,804; 3,755,433, 3,822,209, and 5,084,197.

Preferred dispersants include borated and non-borated succinimides, including those derivatives from mono-succinimides, bis-succinimides, and/or mixtures of mono- and bis-succinimides, wherein the hydrocarbyl succinimide is derived from a hydrocarbylene group such as polyisobutylene having a Mn of from about 500 to about 5000, or from about 1000 to about 3000, or about 1000 to about 2000, or a mixture of such hydrocarbylene groups, often with high terminal vinylic groups. Other preferred dispersants include succinic acid-esters and amides, alkylphenol-polyamine-coupled Mannich adducts, their capped derivatives, and other related components.

Polymethacrylate or polyacrylate derivatives are another class of dispersants. These dispersants are typically prepared by reacting a nitrogen containing monomer and a methacrylic or acrylic acid esters containing 5-25 carbon atoms in the ester group. Representative examples are shown in U.S. Pat. Nos. 2,100,993, and 6,323,164. Polymethacrylate and polyacrylate dispersants are normally used as multifunctional viscosity modifiers. The lower molecular weight versions can be used as lubricant dispersants or fuel detergents.

Illustrative preferred dispersants useful in this disclosure include those derived from polyalkenyl-substituted mono- or dicarboxylic acid, anhydride or ester, which dispersant has a polyalkenyl moiety with a number average molecular weight of at least 900 and from greater than 1.3 to 1.7, preferably from greater than 1.3 to 1.6, most preferably from greater than 1.3 to 1.5, functional groups (mono- or dicarboxylic acid producing moieties) per polyalkenyl moiety (a medium functionality dispersant). Functionality (F) can be determined according to the following formula:

$$F=(SAP\times M_n)/((112{,}200\times \text{A.I.})-(SAP\times 98))$$

wherein SAP is the saponification number (i.e., the number of milligrams of KOH consumed in the complete neutralization of the acid groups in one gram of the succinic-containing reaction product, as determined according to ASTM D94); $M_n$ is the number average molecular weight of the starting olefin polymer; and A.I. is the percent active ingredient of the succinic-containing reaction product (the remainder being unreacted olefin polymer, succinic anhydride and diluent).

The polyalkenyl moiety of the dispersant may have a number average molecular weight of at least 900, suitably at least 1500, preferably between 1800 and 3000, such as between 2000 and 2800, more preferably from about 2100 to 2500, and most preferably from about 2200 to about 2400. The molecular weight of a dispersant is generally expressed in terms of the molecular weight of the polyalkenyl moiety. This is because the precise molecular weight range of the dispersant depends on numerous parameters including the type of polymer used to derive the dispersant, the number of functional groups, and the type of nucleophilic group employed.

Polymer molecular weight, specifically $M_n$, can be determined by various known techniques. One convenient method is gel permeation chromatography (GPC), which additionally provides molecular weight distribution information (see W. W. Yau, J. J. Kirkland and D. D. Bly, "Modern Size Exclusion Liquid Chromatography", John Wiley and Sons, New York, 1979). Another useful method for determining molecular weight, particularly for lower molecular weight polymers, is vapor pressure osmometry (e.g., ASTM D3592).

The polyalkenyl moiety in a dispersant preferably has a narrow molecular weight distribution (MWD), also referred to as polydispersity, as determined by the ratio of weight average molecular weight ($M_w$) to number average molecular weight ($M_n$). Polymers having a $M_w/M_n$ of less than 2.2, preferably less than 2.0, are most desirable. Suitable polymers have a polydispersity of from about 1.5 to 2.1, preferably from about 1.6 to about 1.8.

Suitable polyalkenes employed in the formation of the dispersants include homopolymers, interpolymers or lower molecular weight hydrocarbons. One family of such polymers comprise polymers of ethylene and/or at least one $C_3$ to $C_2$ alpha-olefin having the formula $H_2C{=}CHR^1$ wherein $R^1$ is a straight or branched chain alkyl radical comprising 1 to 26 carbon atoms and wherein the polymer contains carbon-to-carbon unsaturation, and a high degree of terminal ethenylidene unsaturation. Preferably, such polymers comprise interpolymers of ethylene and at least one alpha-olefin of the above formula, wherein $R^1$ is alkyl of from 1 to 18 carbon atoms, and more preferably is alkyl of from 1 to 8 carbon atoms, and more preferably still of from 1 to 2 carbon atoms.

Another useful class of polymers is polymers prepared by cationic polymerization of monomers such as isobutene and styrene. Common polymers from this class include polyisobutenes obtained by polymerization of a $C_4$ refinery stream having a butene content of 35 to 75% by wt., and an isobutene content of 30 to 60% by wt. A preferred source of monomer for making poly-n-butenes is petroleum feedstreams such as Raffinate II. These feedstocks are disclosed in the art such as in U.S. Pat. No. 4,952,739. A preferred embodiment utilizes polyisobutylene prepared from a pure isobutylene stream or a Raffinate I stream to prepare reactive isobutylene polymers with terminal vinylidene olefins. Polyisobutene polymers that may be employed are generally based on a polymer chain of from 1500 to 3000.

The dispersant(s) are preferably non-polymeric (e.g., mono- or bis-succinimides). Such dispersants can be prepared by conventional processes such as disclosed in U.S. Patent Application Publication No. 2008/0020950, the disclosure of which is incorporated herein by reference.

The dispersant(s) can be borated by conventional means, as generally disclosed in U.S. Pat. Nos. 3,087,936, 3,254,025 and 5,430,105.

Such dispersants may be used in an amount of about 0.01 to 20 weight percent or 0.01 to 10 weight percent, preferably about 0.5 to 8 weight percent, or more preferably 0.5 to 4 weight percent. Or such dispersants may be used in an amount of about 2 to 12 weight percent, preferably about 4 to 10 weight percent, or more preferably 6 to 9 weight percent. On an active ingredient basis, such additives may be used in an amount of about 0.06 to 14 weight percent, preferably about 0.3 to 6 weight percent. The hydrocarbon portion of the dispersant atoms can range from $C_{60}$ to $C_{1000}$, or from $C_{70}$ to $C_{300}$, or from $C_{70}$ to $C_{200}$. These dispersants may contain both neutral and basic nitrogen, and mixtures of both. Dispersants can be end-capped by borates and/or cyclic carbonates.

As used herein, the dispersant concentrations are given on an "as delivered" basis. Typically, the active dispersant is delivered with a process oil. The "as delivered" dispersant typically contains from about 20 weight percent to about 80 weight percent, or from about 40 weight percent to about 60 weight percent, of active dispersant in the "as delivered" dispersant product.

Viscosity Modifiers

Viscosity modifiers (also known as viscosity index improvers (VI improvers), and viscosity improvers) can be included in the lubricant compositions of this disclosure.

Viscosity modifiers provide lubricants with high and low temperature operability. These additives impart shear stability at elevated temperatures and acceptable viscosity at low temperatures.

Suitable viscosity modifiers include high molecular weight hydrocarbons, polyesters and viscosity modifier dispersants that function as both a viscosity modifier and a dispersant. Typical molecular weights of these polymers are between about 10,000 to 1,500,000, more typically about 20,000 to 1,200,000, and even more typically between about 50,000 and 1,000,000.

Examples of suitable viscosity modifiers are linear or star-shaped polymers and copolymers of methacrylate, butadiene, olefins, or alkylated styrenes. Polyisobutylene is a commonly used viscosity modifier. Another suitable viscosity modifier is polymethacrylate (copolymers of various chain length alkyl methacrylates, for example), some formulations of which also serve as pour point depressants. Other suitable viscosity modifiers include copolymers of ethylene and propylene, hydrogenated block copolymers of styrene and isoprene, and polyacrylates (copolymers of various chain length acrylates, for example). Specific examples include styrene-isoprene or styrene-butadiene based polymers of 50,000 to 200,000 molecular weight.

Olefin copolymers are commercially available from Chevron Oronite Company LLC under the trade designation "PARATONE®" (such as "PARATONE® 8921" and "PARATONE® 8941"); from Afton Chemical Corporation under the trade designation "HiTEC®" (such as "HiTEC® 5850B"; and from The Lubrizol Corporation under the trade designation "Lubrizol® 7067C". Hydrogenated polyisoprene star polymers are commercially available from Infineum International Limited, e.g., under the trade designation "SV200" and "SV600". Hydrogenated diene-styrene block copolymers are commercially available from Infineum International Limited, e.g., under the trade designation "SV 50".

The polymethacrylate or polyacrylate polymers can be linear polymers which are available from Evnoik Industries under the trade designation "Viscoplex®" (e.g., Viscoplex 6-954) or star polymers which are available from Lubrizol Corporation under the trade designation Asteric™ (e.g., Lubrizol 87708 and Lubrizol 87725).

Illustrative vinyl aromatic-containing polymers useful in this disclosure may be derived predominantly from vinyl aromatic hydrocarbon monomer. Illustrative vinyl aromatic-containing copolymers useful in this disclosure may be represented by the following general formula:

A-B wherein A is a polymeric block derived predominantly from vinyl aromatic hydrocarbon monomer, and B is a polymeric block derived predominantly from conjugated diene monomer.

In an embodiment of this disclosure, the viscosity modifiers may be used in an amount of less than about 2.0 weight percent, preferably less than about 1.0 weight percent, and more preferably less than about 0.5 weight percent, based on the total weight of the formulated oil or lubricating engine oil. Viscosity modifiers are typically added as concentrates, in large amounts of diluent oil.

As used herein, the viscosity modifier concentrations are given on an "as delivered" basis. Typically, the active polymer is delivered with a diluent oil. The "as delivered" viscosity modifier typically contains from 20 weight percent to 75 weight percent of an active polymer for polymethacrylate or polyacrylate polymers, or from 8 weight percent to 20 weight percent of an active polymer for olefin copolymers, hydrogenated polyisoprene star polymers, or hydrogenated diene-styrene block copolymers, in the "as delivered" polymer concentrate.

Antioxidants

Antioxidants retard the oxidative degradation of base oils during service. Such degradation may result in deposits on metal surfaces, the presence of sludge, or a viscosity increase in the lubricant. One skilled in the art knows a wide variety of oxidation inhibitors that are useful in lubricating oil compositions. See, Klamann in Lubricants and Related Products, op cite, and U.S. Pat. Nos. 4,798,684 and 5,084,197, for example.

Useful antioxidants include hindered phenols. These phenolic antioxidants may be ashless (metal-free) phenolic compounds or neutral or basic metal salts of certain phenolic compounds. Typical phenolic antioxidant compounds are the hindered phenolics which are the ones which contain a sterically hindered hydroxyl group, and these include those derivatives of dihydroxy aryl compounds in which the hydroxyl groups are in the o- or p-position to each other. Typical phenolic antioxidants include the hindered phenols substituted with $C_6$+ alkyl groups and the alkylene coupled derivatives of these hindered phenols. Examples of phenolic materials of this type 2-t-butyl-4-heptyl phenol; 2-t-butyl-4-octyl phenol; 2-t-butyl-4-dodecyl phenol; 2,6-di-t-butyl-4-heptyl phenol; 2,6-di-t-butyl-4-dodecyl phenol; 2-methyl-6-t-butyl-4-heptyl phenol; and 2-methyl-6-t-butyl-4-dodecyl phenol. Other useful hindered mono-phenolic antioxidants may include for example hindered 2,6-di-alkyl-phenolic proprionic ester derivatives. Bis-phenolic antioxidants may also be advantageously used in combination with the instant disclosure. Examples of ortho-coupled phenols include: 2,2'-bis(4-heptyl-6-t-butyl-phenol); 2,2'-bis(4-octyl-6-t-butyl-phenol); and 2,2'-bis(4-dodecyl-6-t-butyl-phenol). Para-coupled bisphenols include for example 4,4'-bis(2,6-di-t-butyl phenol) and 4,4'-methylene-bis(2,6-di-t-butyl phenol).

Effective amounts of one or more catalytic antioxidants may also be used. The catalytic antioxidants comprise an effective amount of a) one or more oil soluble polymetal organic compounds; and, effective amounts of b) one or more substituted N,N'-diaryl-o-phenylenediamine compounds or c) one or more hindered phenol compounds; or a combination of both b) and c). Catalytic antioxidants are more fully described in U.S. Pat. No. 8,048,833, herein incorporated by reference in its entirety.

Non-phenolic oxidation inhibitors which may be used include aromatic amine antioxidants and these may be used either as such or in combination with phenolics. Typical examples of non-phenolic antioxidants include: alkylated and non-alkylated aromatic amines such as aromatic monoamines of the formula $R^8R^9R^{10}N$ where $R^8$ is an aliphatic, aromatic or substituted aromatic group, $R^9$ is an aromatic or a substituted aromatic group, and $R^{10}$ is H, alkyl, aryl or $R^{11}S(O)_xR^{12}$ where $R^{11}$ is an alkylene, alkenylene, or aralkylene group, $R^{12}$ is a higher alkyl group, or an alkenyl, aryl, or alkaryl group, and x is 0, 1 or 2. The aliphatic group $R^8$ may contain from 1 to about 20 carbon atoms, and preferably contains from about 6 to 12 carbon atoms. The aliphatic group is a saturated aliphatic group. Preferably, both $R^8$ and $R^9$ are aromatic or substituted aromatic groups, and the aromatic group may be a fused ring aromatic group such as naphthyl. Aromatic groups $R^8$ and $R^9$ may be joined together with other groups such as S.

Typical aromatic amines antioxidants have alkyl substituent groups of at least about 6 carbon atoms. Examples of aliphatic groups include hexyl, heptyl, octyl, nonyl, and decyl. Generally, the aliphatic groups will not contain more than about 14 carbon atoms. The general types of amine antioxidants useful in the present compositions include diphenylamines, phenyl naphthylamines, phenothiazines, imidodibenzyls and diphenyl phenylene diamines. Mixtures of two or more aromatic amines are also useful. Polymeric amine antioxidants can also be used. Particular examples of aromatic amine antioxidants useful in the present disclosure include: p,p'-dioctyldiphenylamine; t-octylphenyl-alpha-naphthylamine; phenyl-alphanaphthylamine; and p-octylphenyl-alpha-naphthylamine.

Sulfurized alkyl phenols and alkali or alkaline earth metal salts thereof also are useful antioxidants.

Preferred antioxidants include hindered phenols, arylamines. These antioxidants may be used individually by type or in combination with one another. Such additives may be used in an amount of about 0.01 to 5 weight percent, preferably about 0.01 to 1.5 weight percent, more preferably zero to less than 1.5 weight percent, more preferably zero to less than 1 weight percent.

Pour Point Depressants (PPDs)

Conventional pour point depressants (also known as lube oil flow improvers) may be added to the compositions of the present disclosure if desired. These pour point depressant may be added to lubricating compositions of the present disclosure to lower the minimum temperature at which the fluid will flow or can be poured. Examples of suitable pour point depressants include polymethacrylates, polyacrylates, polyarylamides, condensation products of haloparaffin waxes and aromatic compounds, vinyl carboxylate polymers, and terpolymers of dialkylfumarates, vinyl esters of fatty acids and allyl vinyl ethers. U.S. Pat. Nos. 1,815,022; 2,015,748; 2,191,498; 2,387,501; 2,655, 479; 2,666,746; 2,721,877; 2,721,878; and 3,250,715 describe useful pour point depressants and/or the preparation thereof. Such additives may be used in an amount of about 0.01 to 5 weight percent, preferably about 0.01 to 1.5 weight percent.

Seal Compatibility Agents

Seal compatibility agents help to swell elastomeric seals by causing a chemical reaction in the fluid or physical change in the elastomer. Suitable seal compatibility agents for lubricating oils include organic phosphates, aromatic esters, aromatic hydrocarbons, esters (butylbenzyl phthalate, for example), and polybutenyl succinic anhydride. Such additives may be used in an amount of about 0.01 to 3 weight percent, preferably about 0.01 to 2 weight percent.

Antifoam Agents

Anti-foam agents may advantageously be added to lubricant compositions. These agents retard the formation of stable foams. Silicones and organic polymers are typical anti-foam agents. For example, polysiloxanes, such as silicon oil or polydimethyl siloxane, provide antifoam properties. Anti-foam agents are commercially available and may be used in conventional minor amounts along with other additives such as demulsifiers; usually the amount of these additives combined is less than 1 weight percent and often less than 0.1 weight percent.

Inhibitors and Antirust Additives

Antirust additives (or corrosion inhibitors) are additives that protect lubricated metal surfaces against chemical attack by water or other contaminants. A wide variety of these are commercially available.

One type of antirust additive is a polar compound that wets the metal surface preferentially, protecting it with a film of oil. Another type of antirust additive absorbs water by incorporating it in a water-in-oil emulsion so that only the oil touches the metal surface. Yet another type of antirust additive chemically adheres to the metal to produce a non-reactive surface. Examples of suitable additives include zinc dithiophosphates, metal phenolates, basic metal sulfonates, fatty acids and amines. Such additives may be used in an amount of about 0.01 to 5 weight percent, preferably about 0.01 to 1.5 weight percent.

Friction Modifiers

A friction modifier is any material or materials that can alter the coefficient of friction of a surface lubricated by any lubricant or fluid containing such material(s). Friction modifiers, also known as friction reducers, or lubricity agents or oiliness agents, and other such agents that change the ability of base oils, formulated lubricant compositions, or functional fluids, to modify the coefficient of friction of a lubricated surface may be effectively used in combination with the base oils or lubricant compositions of the present disclosure if desired. Friction modifiers that lower the coefficient of friction are particularly advantageous in combination with the base oils and lube compositions of this disclosure.

Illustrative friction modifiers may include, for example, organometallic compounds or materials, or mixtures thereof. Illustrative organometallic friction modifiers useful in the lubricating engine oil formulations of this disclosure include, for example, molybdenum amine, molybdenum diamine, an organotungstenate, a molybdenum dithiocarbamate, molybdenum dithiophosphates, molybdenum amine complexes, molybdenum carboxylates, and the like, and mixtures thereof. Similar tungsten based compounds may be preferable.

Other illustrative friction modifiers useful in the lubricating engine oil formulations of this disclosure include, for example, alkoxylated fatty acid esters, alkanolamides, polyol fatty acid esters, borated glycerol fatty acid esters, fatty alcohol ethers, and mixtures thereof.

Illustrative alkoxylated fatty acid esters include, for example, polyoxyethylene stearate, fatty acid polyglycol ester, and the like. These can include polyoxypropylene stearate, polyoxybutylene stearate, polyoxyethylene isostearate, polyoxypropylene isostearate, polyoxyethylene palmitate, and the like.

Illustrative alkanolamides include, for example, lauric acid diethylalkanolamide, palmic acid diethylalkanolamide, and the like. These can include oleic acid diethyalkanolamide, stearic acid diethylalkanolamide, oleic acid diethylalkanolamide, polyethoxylated hydrocarbylamides, polypropoxylated hydrocarbylamides, and the like.

Illustrative polyol fatty acid esters include, for example, glycerol mono-oleate, saturated mono-, di-, and tri-glyceride esters, glycerol mono-stearate, and the like. These can include polyol esters, hydroxyl-containing polyol esters, and the like.

Illustrative borated glycerol fatty acid esters include, for example, borated glycerol mono-oleate, borated saturated mono-, di-, and tri-glyceride esters, borated glycerol monosterate, and the like. In addition to glycerol polyols, these can include trimethylolpropane, pentaerythritol, sorbitan, and the like. These esters can be polyol monocarboxylate esters, polyol dicarboxylate esters, and on occasion polyoltricarboxylate esters. Preferred can be the glycerol monooleates, glycerol dioleates, glycerol trioleates, glycerol monostearates, glycerol distearates, and glycerol tristearates and the corresponding glycerol monopalmitates, glycerol dipalmitates, and glycerol tripalmitates, and the respective isostearates, linoleates, and the like. On occasion the glycerol esters can be preferred as well as mixtures containing any of these. Ethoxylated, propoxylated, butoxylated fatty acid esters of polyols, especially using glycerol as underlying polyol can be preferred.

Illustrative fatty alcohol ethers include, for example, stearyl ether, myristyl ether, and the like. Alcohols, including those that have carbon numbers from $C_3$ to $C_{50}$, can be ethoxylated, propoxylated, or butoxylated to form the corresponding fatty alkyl ethers. The underlying alcohol portion can preferably be stearyl, myristyl, $C_{11}$-$C_{13}$ hydrocarbon, oleyl, isosteryl, and the like.

The lubricating oils of this disclosure exhibit desired properties, e.g., wear control, in the presence or absence of a friction modifier.

Useful concentrations of friction modifiers may range from 0.01 weight percent to 5 weight percent, or about 0.1 weight percent to about 2.5 weight percent, or about 0.1 weight percent to about 1.5 weight percent, or about 0.1 weight percent to about 1 weight percent. Concentrations of molybdenum-containing materials are often described in terms of Mo metal concentration. Advantageous concentrations of Mo may range from 25 ppm to 700 ppm or more, and often with a preferred range of 50-200 ppm. Friction modifiers of all types may be used alone or in mixtures with the materials of this disclosure. Often mixtures of two or more friction modifiers, or mixtures of friction modifier(s) with alternate surface active material(s), are also desirable.

When lubricating oil compositions contain one or more of the additives discussed above, the additive(s) are blended into the composition in an amount sufficient for it to perform its intended function. Typical amounts of such additives useful in the present disclosure are shown in Table 1 below.

It is noted that many of the additives are shipped from the additive manufacturer as a concentrate, containing one or more additives together, with a certain amount of base oil diluents. Accordingly, the weight amounts in the table below, as well as other amounts mentioned herein, are directed to the amount of active ingredient (that is the non-diluent portion of the ingredient). The weight percent (wt %) indicated below is based on the total weight of the lubricating oil composition.

TABLE 1

Typical Amounts of Other Lubricating Oil Components

| Compound | Approximate wt % (Useful) | Approximate wt % (Preferred) |
|---|---|---|
| Dispersant | 0.1-20 | 0.1-8 |
| Detergent | 0.1-20 | 0.1-8 |
| Friction Modifier | 0.01-5 | 0.01-1.5 |
| Antioxidant | 0.1-5 | 0.1-1.5 |
| Pour Point Depressant (PPD) | 0.0-5 | 0.01-1.5 |
| Anti-foam Agent | 0.001-3 | 0.001-0.15 |
| Viscosity Modifier (solid polymer basis) | 0.1-2 | 0.1-1 |
| Antiwear | 0.2-3 | 0.5-1 |
| Inhibitor and Antirust | 0.01-5 | 0.01-1.5 |

The foregoing additives are all commercially available materials. These additives may be added independently but are usually precombined in packages which can be obtained from suppliers of lubricant oil additives. Additive packages with a variety of ingredients, proportions and characteristics are available and selection of the appropriate package will take the requisite use of the ultimate composition into account.

Examples of techniques that can be employed to characterize the compositions described herein include, but are not limited to, analytical gas chromatography (GC), Fourier transform infrared (FTIR) spectroscopy, infrared (IR) spectroscopy, nuclear magnetic resonance (NMR), thermogravimetric analysis (TGA), inductively coupled plasma mass spectrometry, differential scanning calorimetry (DSC), volatility and viscosity measurements.

The compositions of this disclosure are useful in a variety of applications. Illustrative applications include, for example, performance additives, separations, analytics, syntheses, electrochemistry, engineering fluids, material syntheses, and the like.

Illustrative performance additive applications include, for example, plasticizers, dispersing agents, compatibilizers, solubilizers, antistatic agents, gas hydrate inhibitors, enhance oil recovery, heavy hydrocarbon viscosity reducers, and the like.

Illustrative separation applications include, for example, gas absorption/storage, extraction, carbon capture, ion containing polymer membranes, and the like.

Illustrative analytic applications include, for example, gas chromatography—columns, stationary phase for high pressure liquid chromatography, matrices for mass spectra, and the like.

Illustrative synthesis applications include, for example, solvents, catalysis, biphasic reactions, manufacture of nanomaterials, and the like.

Illustrative electrochemistry applications include, for example, electrolyte in batteries, electrolyte in sensors, metal plating, and the like.

Illustrative engineering fluid applications include, for example, lubricants, thermo fluids, and the like.

Illustrative material synthesis applications include, for example, templates (also called structure-directing agents) in material synthesis and design of novel structures, and the like.

The following non-limiting examples are provided to illustrate the disclosure.

EXAMPLES

Example 1

Preparation of Tetraoctylphosphonium Bromide/Diphenylamine Mixture (1:1) (Liquid), LTTM 1, Tetraoctylphosphonium Bromide and Diphenylamine Both are Solids at Room Temperature Into 50 g round bottom flask was charged 5.64 g of tetraoctylphosphonium bromide (10.00 mmol, mw 563.76, mp. 38-43° C.) and 1.69 g of diphenylamine (10.00, mw169.22, mp 50-53° C.). The components were heated at 70-80° C. and stirred until a homogeneous liquid was formed. The FTIR analysis of the resultant liquid showed both the peaks of tetraoctylphosphonium bromide and diphenylamine. This analysis also confirmed that the liquid formed was the physical combination of two solid components, i.e., no covalent bonds were formed via chemical reaction. The TGA analysis of the resultant liquid is shown in FIG. 3. LTTM 1 can be represented by the formula below.

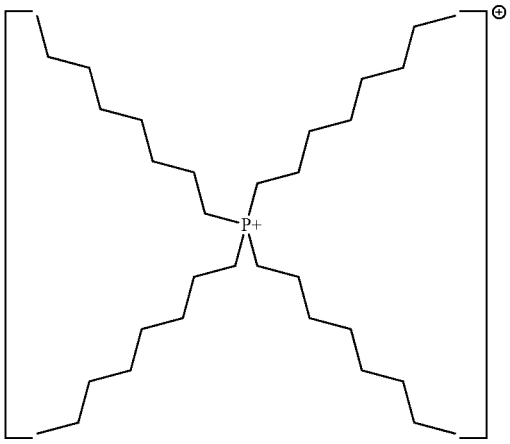

Example 2

Figure 4:
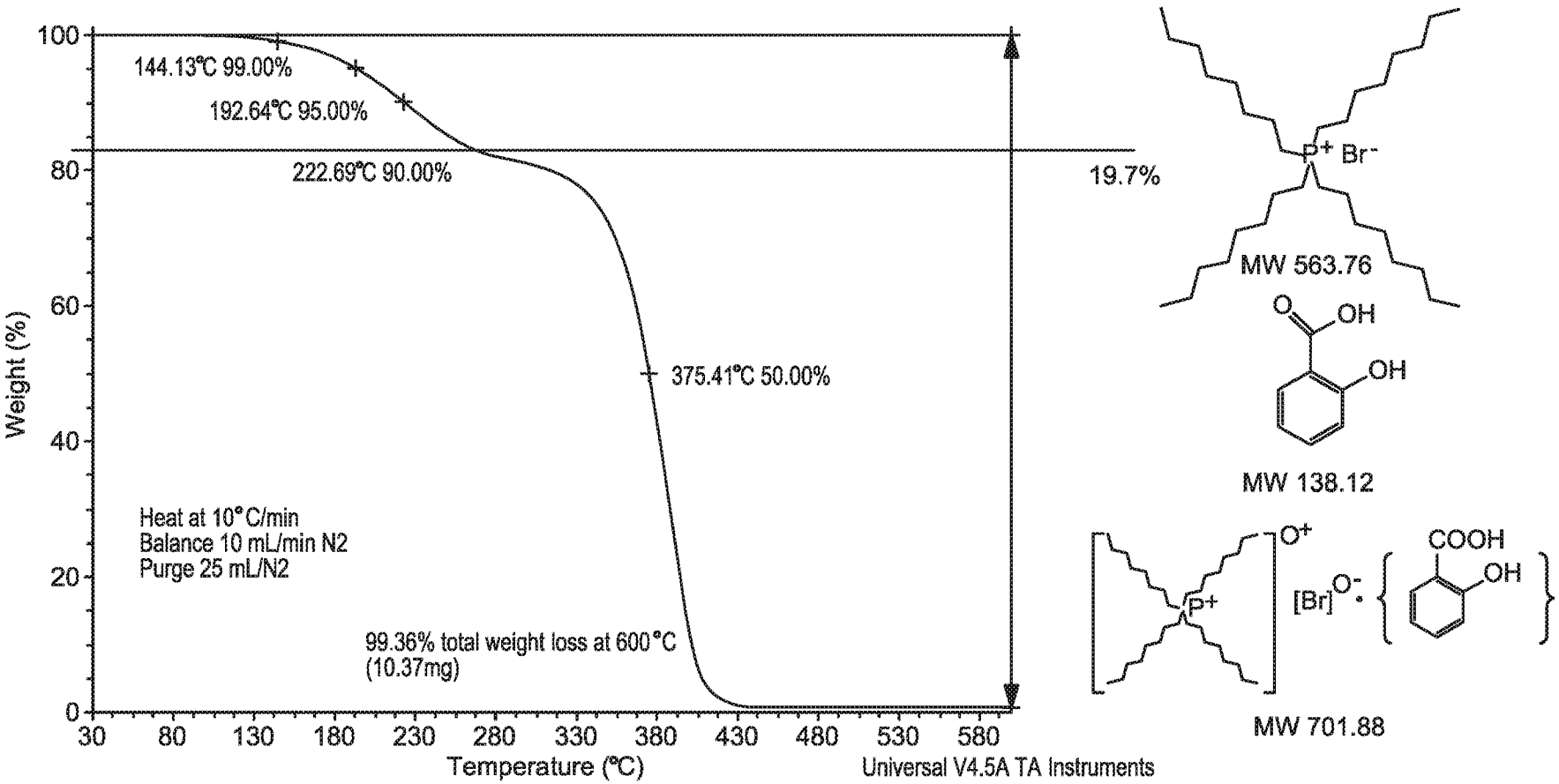
FIG. 4 shows TGA analysis of the resultant liquid prepared in Example 2 of this disclosure.

Preparation of Tetraoctylphosphonium Bromide/Salicylic Acid (2-Hydroxybenzoic Acid) Mixture (1:1) (Liquid), LTTM 2, Tetraoctylphosphonium Bromide and 2-Hydroxybenzoic Acid Both are Solids at Room Temperature Into 50 g round bottom flask was charged 5.64 g of tetraoctylphosphonium bromide (10.00 mmol, mw 563.76, mp 38-43° C.) and 1.38 g of salicylic acid (10.00, mw 138.12, mp 211° C.). The components were heated at 70-80° C. and stirred until a homogeneous liquid was formed. The FTIR analysis of the resultant liquid showed both the peaks of tetraoctylphosphonium bromide and salicylic acid. This analysis also confirmed that the liquid formed was the physical combination of two solid components, i.e., no covalent bonds were formed via chemical reaction. The TGA analysis of the resultant liquid is shown in FIG. 4. LTTM 2 can be represented by the formula below.

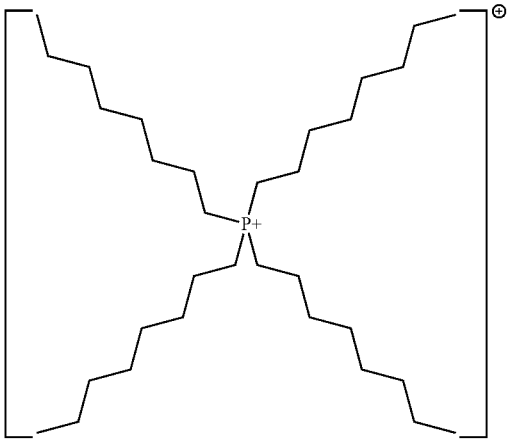

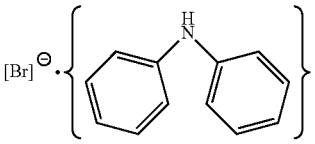

Example 3

Figure 5:
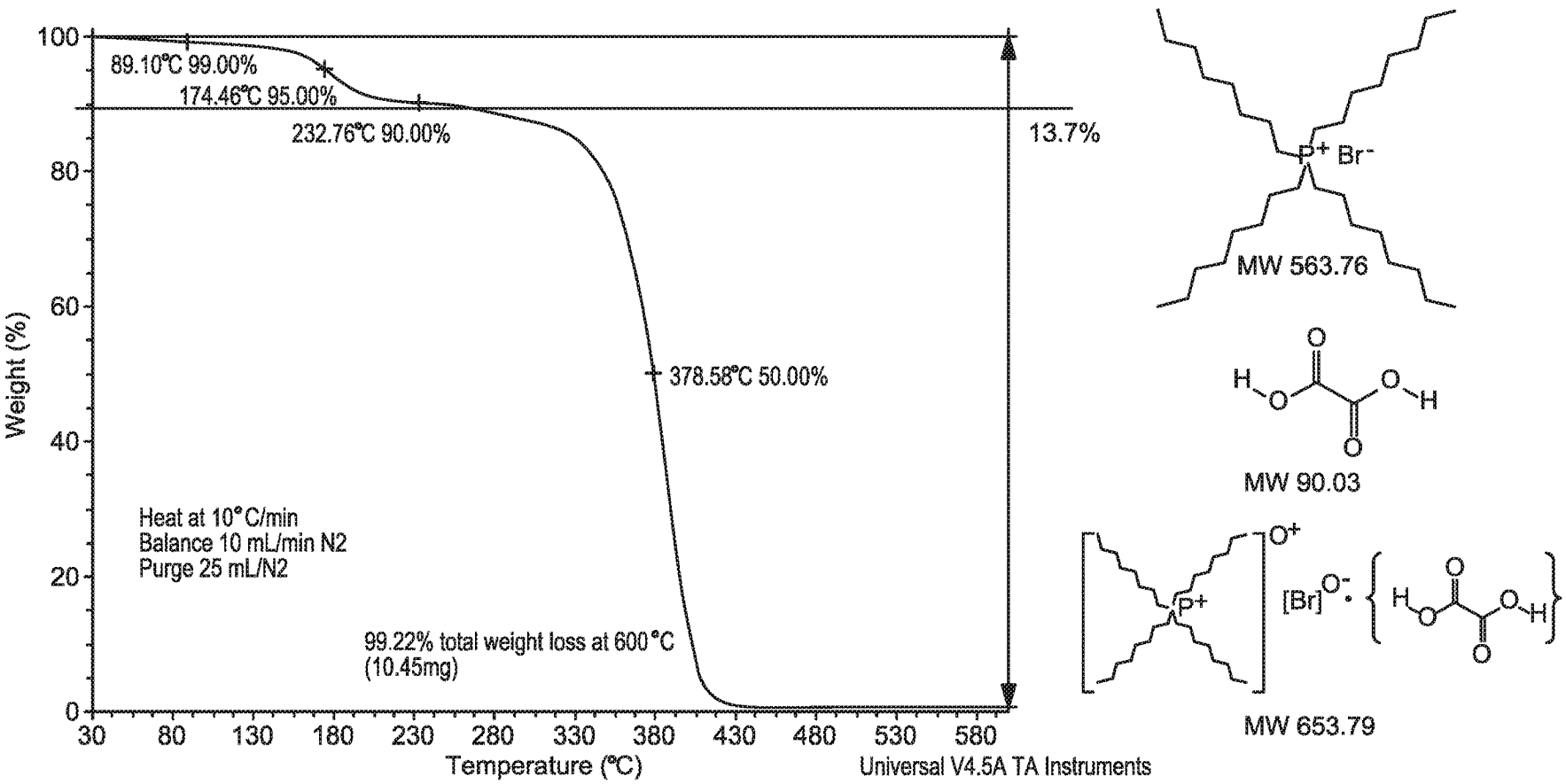
FIG. 5 shows TGA analysis of the resultant liquid prepared in Example 3 of this disclosure.

Preparation of Tetraoctylphosphonium Bromide/Oxalic Acid Mixture (1:1) (Liquid), LTTM 3, Tetraoctylphosphonium Bromide and Oxalic Acid Both are Solids at Room Temperature Into 50 g round bottom flask was charged 5.64 g of tetraoctylphosphonium bromide (10.00 mmol, mw 563.76, mp 38-43° C.) and 0.90 g of oxalic acid (10.00, mw 90.03, mp 189.5° C.). The components were heated at 70-80° C. and stirred until a homogeneous liquid was formed. The FT IR analysis of the resultant liquid showed both the peaks of tetraoctylphosphonium bromide and oxalic acid. This analysis also confirmed that the liquid formed was the physical combination of two solid components, i.e., no covalent bonds were formed via chemical reaction. The TGA analysis of the resultant liquid is shown in FIG. 5. LTTM 3 can be represented by the formula below.

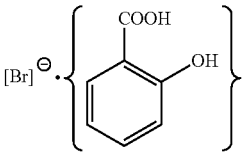

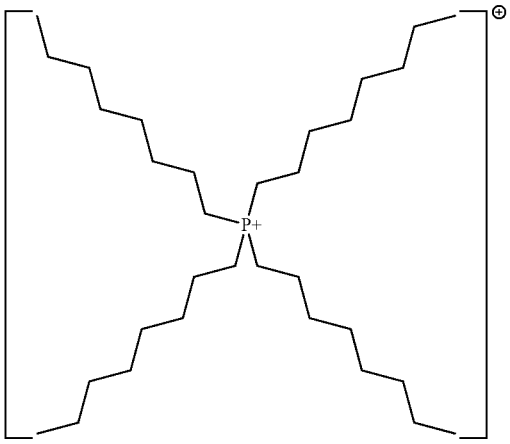

Example 4

Figure 6:
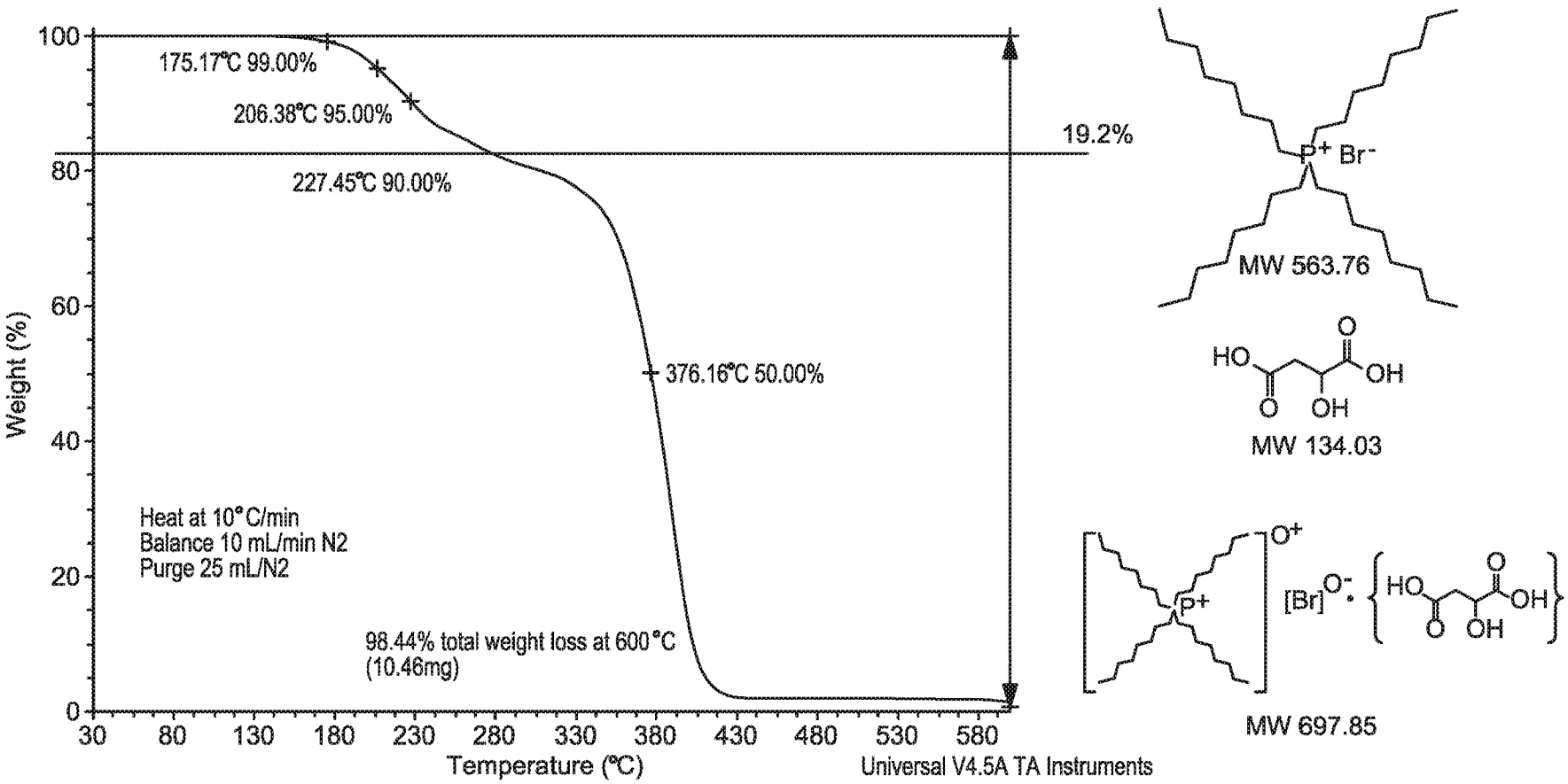
FIG. 6 shows TGA analysis of the resultant liquid prepared in Example 4 of this disclosure.

Preparation of Tetraoctylphosphonium Bromide/Malic Acid Mixture (1:1) (Liquid), LTTM 4, Tetraoctylphosphonium Bromide and Malic Acid Both are Solids at Room Temperature Into 50 g round bottom flask was charged 5.64 g of tetraoctylphosphonium bromide (10.00 mmol, mw 563.76, mp 38-43° C.) and 1.34 g of malic acid (10.00 mmol, mw 134.09, mp 131° C.). The components were heated at 70-80° C. and stirred until a homogeneous liquid was formed. The FTIR analysis of the resultant liquid showed both the peaks of tetraoctylphosphonium bromide and malic acid. This analysis also confirmed that the liquid formed was the physical combination of two solid components, i.e., no covalent bonds were formed via chemical reaction. The TGA analysis of the resultant liquid is shown in FIG. 6. LTTM 4 can be represented by the formula below.

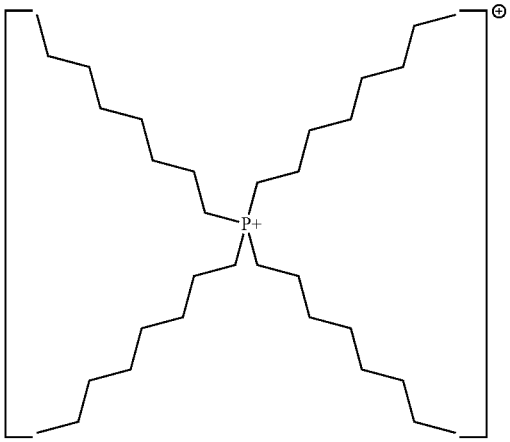

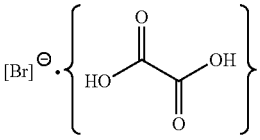

Example 5

Figure 7:
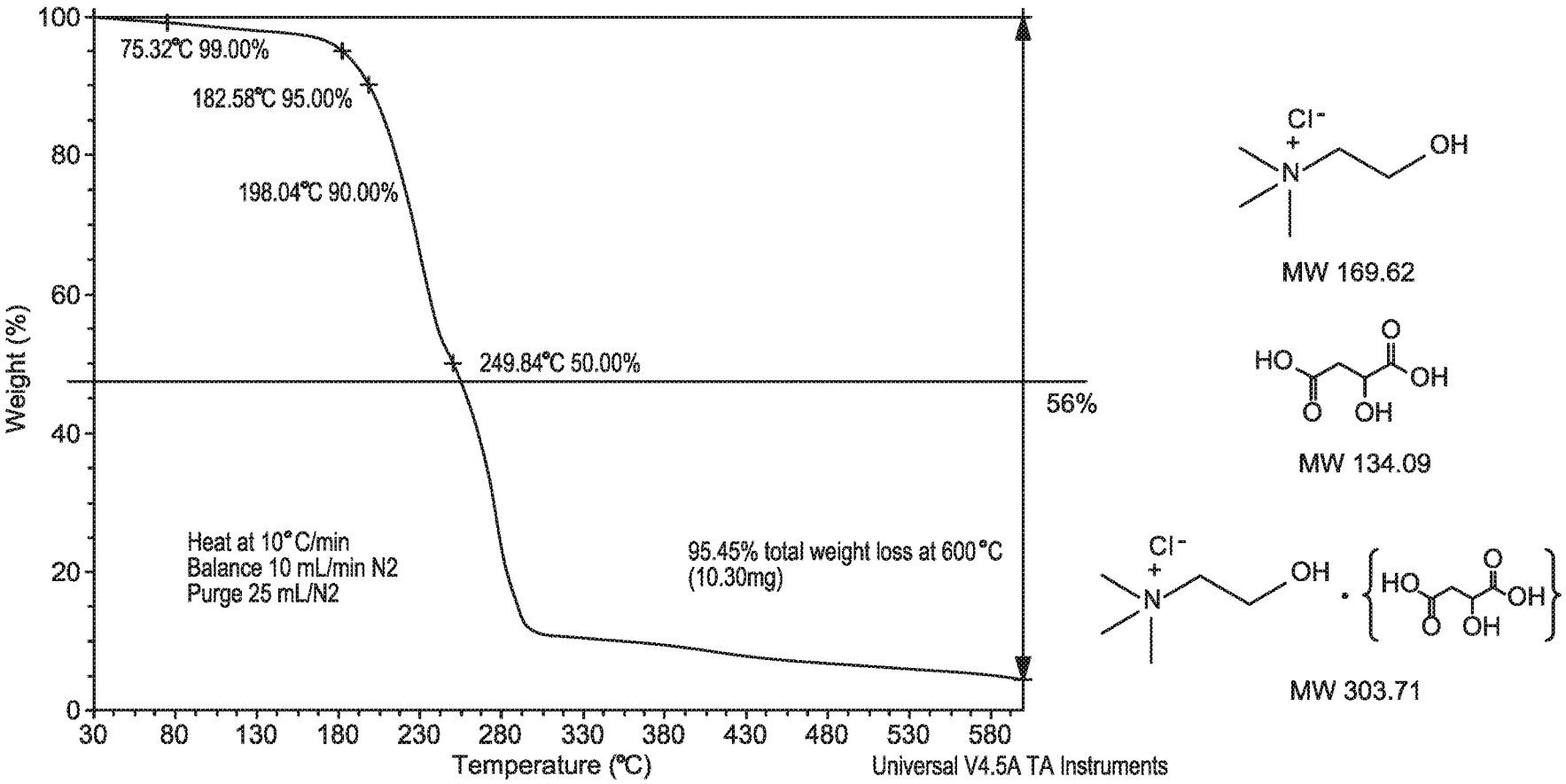
FIG. 7 shows TGA analysis of the resultant liquid prepared in Example 5 of this disclosure.

Preparation of Choline Chloride/Malic Acid Mixture (1:1) (Liquid), LTTM 5, Choline Chloride and Malic Acid Both are Solids at Room Temperature Into 50 g round bottom flask was charged 1.39 g of choline chloride (10.00 mmol, mw139.62, mp 302-305° C.) and 1.34 g of malic acid (10.00 mmol, mw 134.09, mp131° C.). The components were heated at 70-80° C. and stirred until a homogeneous liquid was formed. The FTIR analysis of the resultant liquid showed both peaks of choline chloride and malic acid. This analysis also confirmed that the liquid formed was the physical combination of two solid components, i.e., no covalent bonds were formed via chemical reaction. The TGA analysis of the resultant liquid is shown in FIG. 7. LTTM 5 can be represented by the formula below.

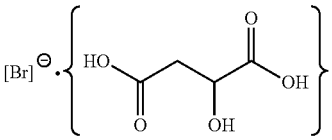

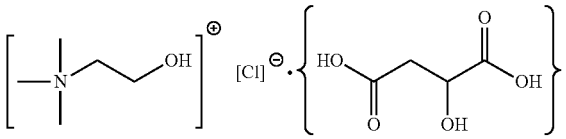

Example 6

Preparation of Choline Chloride/Lactic Acid Mixture (1:2) (Liquid), LTTM 6

Into 50 g round bottom flask was charged 1.39 g of choline chloride (10.00 mmol, mw139.62, mp 302-305° C.) and 1.80 g of lactic acid (20.00 mmol, mw 90.03, BP 122° C./15 mm). The components were heated at 70-80° C. and stirred until a homogeneous liquid was formed. The FTIR analysis of resultant liquid showed both the peaks of choline chloride and lactic acid. This analysis also confirmed that the liquid formed was the physical combination of two components, i.e., no covalent bonds were formed via chemical reaction. LTTM 6 can be represented by the formula below.

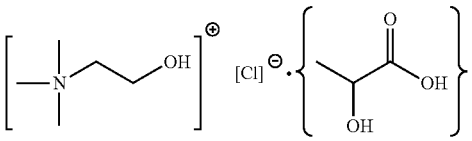

Example 7

Preparation of 1-Ethyl-3-Methylimidazolium Bromide/Oxalic Acid Mixture (2:1) (Liquid), LTTM 7, 1-Ethyl-3-Methylimidazolium Bromide and Oxalic Acid Both are Solids at Room Temperature Into 50 g round bottom flask was charged 3.82 g of 1-ethyl-3-methylimidazolium bromide (20.00 mmol, mw191.0, mp 70-73° C.) and 0.90 g of oxalic acid (10.00, mw 90.03, mp 189.5° C.). The components were heated at 70-80° C. and stirred until a homogeneous liquid was formed. The FTIR analysis of resultant liquid showed both the peaks of 1-ethyl-3-methylimidazolium bromide and oxalic acid. This analysis also confirmed that the liquid formed was the physical combination of two solid components, i.e., no covalent bonds were formed via chemical reaction. LTTM 7 can be represented by the formula below.

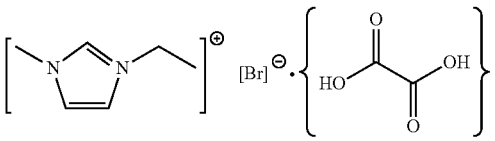

Example 8

Preparation of Tributyldodecylphosphonium Bromide/Dipenylamine Mixture (1:1) (Liquid), LTTM 8, Tributyldodecylphosphonium Bromide and Diphenylamine Both are Solids at Room Temperature Into 50 g round bottom flask was charged 4.51 g of tributyldodecylphosphonium bromide (10.00 mmol, mw 451.56, mp 33° C.) and 1.69 g of diphenylamine (10.00, mw 169.22, mp 50-53° C.). The components were heated at 70-80° C. and stirred until a homogeneous liquid was formed. The FTIR analysis of resultant liquid showed both the peaks of tributyldodecylphosphonium bromide and diphenylamine. This analysis also confirmed that the liquid formed was the physical combination of two solid components, i.e., no covalent bonds were formed via chemical reaction. LTTM 8 can be represented by the formula below.

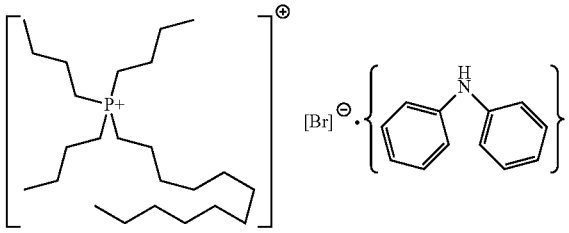

Example 9

Preparation of Tributyldodecylphosphonium Bromide/Salicyclic Acid Mixture (1:1) (Liquid), LTTM 9, Tributyldodecylphosphonium Bromide and Salicyclic Acid Both are Solids at Room Temperature Into 50 g round bottom flask was charged 4.51 g of tributyldodecylphosphonium bromide (10.00 mmol, mw 451.56, mp 33° C.) and 1.38 g of salicylic acid (10.00, mw 138.12, mp: 211° C.). The components were heated at 70-80° C. and stirred until a homogeneous liquid was formed. The FTIR analysis of resultant liquid showed both the peaks of tributyldodecylphosphonium bromide and salicylic acid. This analysis also confirmed that the liquid formed was the physical combination of two solid components, i.e., no covalent bonds were formed via chemical reaction. LTTM 9 can be represented by the formula below.

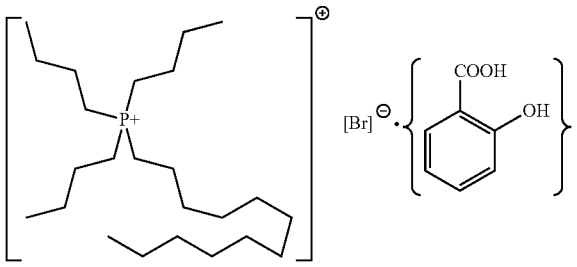

Example 10

Preparation of Tetrahexylphosphonium Bromide/1,2-Decanediol Mixture (1:1) (Liquid), LTTM 10, Tetrahexylphosphonium Bromide and 1,2-Decanediol Both are Solids at Room Temperature Into 50 g round bottom flask was charged 3.90.16 g of tetrahexylamine chloride (10.00 mmol, mw 390.13, mp 111-113° C.) and 1.74 g of 1,2-decanediol (10.00, mw 174.28, mp 48-50° C.). The components were heated at 70-80° C. and stirred until a homogeneous liquid was formed. The FTIR analysis of resultant liquid showed both the peaks of tetrahexylamine chloride and 1,2-decanediol. This analysis also confirmed that the liquid formed was the physical combination of two components, i.e., no covalent bonds were formed via chemical reaction. LTTM 10 can be represented by the formula below.

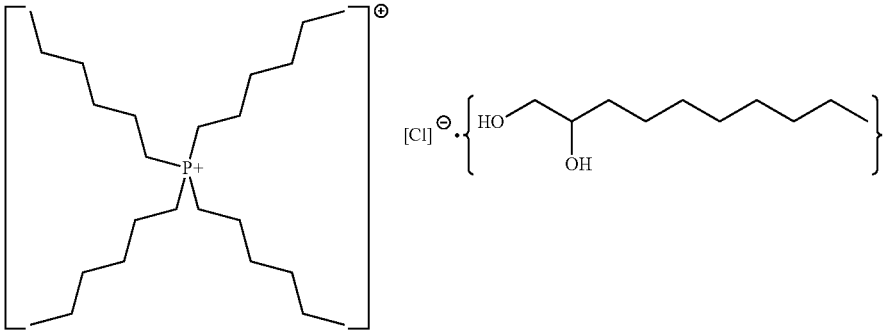

Example 11

Preparation of Tributyldodecylphosphonium Bromide/1,2-Decanediol Mixture (1:1), (Liquid), LTTM 11, Tributyldodecylphosphonium Bromide and 1,2-Decanediol Both are Solids at Room Temperature Into 50 g round bottom flask was charged 4.51 g of tributyldodecylphosphonium bromide (10.00 mmol, mw 451.56, mp 33° C.) and 1.74 g of 1,2-decanediol (10.00, mw 174.28, mp 48-50° C.). The components were heated at 70-80° C. and stirred until a homogeneous liquid was formed. The FTIR analysis of resultant liquid showed both the peaks of tributyldodecylphosphonium bromide and 1,2-decanediol. This analysis also confirmed that the liquid formed was the physical combination of two components, i.e., no covalent bonds were formed via chemical reaction. LTTM 11 can be represented by the formula below.

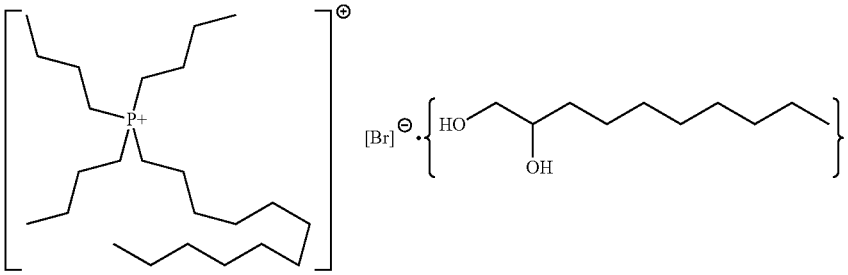

Example 12

Preparation of 1-Ethyl-3-Methylimidazolium Bromide/1,2-Decanediol Mixture (2:1) (Liquid), LTTM 12, 1-Ethyl-3-Methylimidazolium Bromide and 1,2-Decanediol Mixture Both are Solids at Room Temperature Into 50 g round bottom flask was charged 3.82 g of 1-ethyl-3-methylimidazolium bromide (20.00 mmol, mw 191.0, mp 70-73° C.) and 1.74 g of 1,2-decanediol (10.00, mw 174.28, mp 48-50° C.). The components were heated at 70-80° C. and stirred until a homogeneous liquid was formed. FTIR analysis of resultant liquid showed both the peaks of 1-ethyl-3-methylimidazolium bromide and 1,2-decanediol. This analysis also confirmed that the liquid formed was the physical combination of two components, i.e., no covalent bonds were formed via chemical reaction. LTTM 12 can be represented by the formula below.

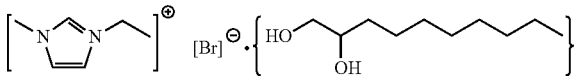

Example 13

Preparation of Tributyldodecylphosphonium Bromide/1-Oleoyl-Rac-Glycerol (1:1) (Liquid), LTTM 13

Into 50 g round bottom flask was charged 4.51 g of tributyldodecylphosphonium bromide (10.00 mmol, mw 451.56, mp 33° C.) and 3.56 g of 1-oleoyl-rac-glycerol (10.00 mmol, mw 356.54). The components were heated at 70-80° C. and stirred until a homogeneous liquid was formed. The FTIR analysis of resultant liquid showed both the peaks of tributyldodecyl phosphonium bromide and 1-oleoyl-rac-glycerol. This analysis also confirmed that the liquid formed was the physical combination of two components, i.e., no covalent bonds were formed via chemical reaction. LTTM 13 can be represented by the formula below.

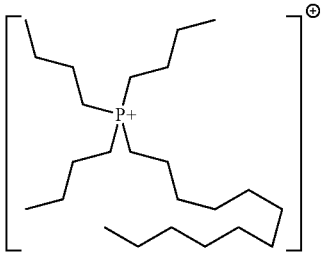

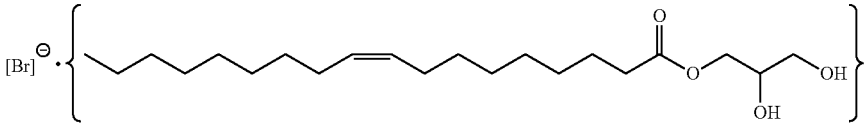

Example 14

Lube Properties of LTTMs as Base Stocks

The products were evaluated as synthetic base stocks. The kinematic viscosity (Kv) of the liquid products were measured using ASTM standards D-445 and reported at temperatures of 100° C. (Kv at 100° C.) or 40° C. (Kv at 40° C.). The viscosity index (VI) was measured according to ASTM standard D-2270 using the measured kinematic viscosities for each product. The results are given in FIG. 1. The products were evaluated as synthetic base stocks. The results of solubility testing are given in FIG. 2. As used in FIG. 2, "clear" means dissolved completely and cleat solution (miscible). As used in FIG. 2, "cloudy" means not dissolved and separated later (immiscible).

PCT and EP Clauses:

1. A composition comprising: a eutectic mixture of at least a first component comprising a hydrogen bond acceptor and at least a second component comprising a hydrogen bond donor; wherein the eutectic mixture comprises an equilibrium phase between the at least first component and the at least second component, and wherein the equilibrium phase does not exhibit physical characteristics of the at least first component in an unmixed state and the at least second component in an unmixed state; wherein the at least first component and the at least second component form an intermolecular interaction between each other sufficient to prevent crystallization of the at least first component and the at least second component in the eutectic mixture; and wherein the eutectic mixture is a liquid at 20° C.

2. The composition of clause 1 which has a kinematic viscosity at a temperature of 100° C. ($Kv_{100}$), measured according to ASTM standard D-445, from 2 to 300 cst, a kinematic viscosity at a temperature of 40° C. ($Kv_{40}$), measured according to ASTM standard D-445, from 5 to 4000 cst, a viscosity index (VI), measured according to ASTM standard D-2270, from −100 to 300, and a Noack volatility, measured according to ASTM D-5800, of no greater than 90 percent.

3. The composition of clauses 1 and 2 wherein the hydrogen bond acceptor comprises an amino acid, a salt including an organic salt and natural salt, or mixtures thereof.

4. The composition of clauses 1 and 2 wherein the hydrogen bond donor comprises an organic acid, alcohol, polyol, aldehyde, carbohydrate, saccharide, or mixtures thereof.

5. The composition of clauses 1 and 2 wherein the hydrogen bond acceptor comprises tetraoctylphosphonium bromide, (2-hydroxyethyl)trimethylammonium chloride (choline), 1-ethyl-3-methylimidazolium bromide, tributyldodecylphosphonium bromide, tetrahexylammonium chloride, ethylammonium chloride, tetramethylammonium chloride, alanine, betaine, glycine, histidine, proline, ethyl(2-hydroxyethyl)-dimethylammonium chloride, chloline nitrate, trimethylammonium chloride, triethylammonium bromide, chloline tetrafluoroborate, chlorochloline chloride, 2-fluoroethyl-trimethylammonium bromide, acetylchloline chloride, choline fluoride, benzyldimethyl(2-hydroxyethyl)-ammonium chloride, diethyl(2-hydroethyl)-ammonium chloride, lidocaine, tetrabutylammonium chloride, (phenylmethyl)triphenyl phosphonium chloride, methyltriphenylphosphonium bromide, tributyloctylphosphonium bromide, 1-ethyl-3-methylimidazolium chloride, tetraoctylammonium bromide, methyltrioctylammonium bromide, 1-butyl-3-methylimidazolium chloride, tetrabutylphosphonium methanesulfonate, (2-hydroxyethyl)benzyldimethylammonium chloride, trihexyltetradecylphosphonium chloride, trihexyltetradecylphosphonium bromide, (2-chloroethyl)trimethylammonium chloride, (2-chloroethyl)trimethylammonium bromide, (2-acetoxy)trimethylammonium chloride, or mixtures thereof.

6. The composition of clauses 1 and 2 wherein the hydrogen bond donor comprises lactic acid, malic acid, oxalic acid (anhydrous or dihydrate), nicotinic acid, acetamide, malonic acid, xylitol, urea, 1,2-dimethylurea, D-isosorbide, tartatic acid, tricarballylic acid, thiourea, trifluoroacetamide, benzoic acid, itaconic acid, citric acid, imidazole, 2-imidazolinone, benzamide, 4-hydroxybenzoic acid, cinnamic acid, ethylene glycol, propylene urea, resorcinol, phenylacetic acid, D-sorbitol, 1,3-dimethylurea, levulinic acid, gallic acid, caffeic acid, 1-methylurea, glycerol, succinic acid, hexanoic acid, coumaric acid, stearic acid, oleic acid, linoleic acid, adipic acid, suberic acid, decanoic acid, trichloroacetic acid, phenlyacetic acid, p-toluene sulfonic acid, cresol, phenol, ethylene glycol, glycerol, fructose, phenothiazine, or mixtures thereof.

7. A process comprising:

providing at least a first component comprising a hydrogen bond acceptor and at least a second component comprising a hydrogen bond donor; wherein the at least first component and the at least second component are solids at 20° C.;

heating either the at least first component or the at least second component, whichever has the lowest melting point, at a temperature sufficient to melt either the at least first component or the at least second component having the lowest melting point; and dissolving either the at least first component or the at least second component, whichever does not have the lowest melting point, in either the melted at least first component or the melted at least second component, to form a eutectic mixture;

wherein the eutectic mixture comprises an equilibrium phase between the at least first component and the at least second component, and wherein the equilibrium phase does not exhibit physical characteristics of the at least first component and the at least second component; wherein the at least first component and the at least second component form an intermolecular interaction between each other sufficient to prevent crystallization of the at least first component and the at least second component in the eutectic mixture; and wherein the eutectic mixture is a liquid at 20° C.

8. The process of clause 7 wherein the intermolecular interaction comprises hydrogen bonding or Van der Waals force.

9. A lubricating oil base stock comprising: a eutectic mixture containing at least a first component comprising a hydrogen bond acceptor and at least a second component comprising a hydrogen bond donor; wherein the eutectic mixture comprises an equilibrium phase between the at least first component and the at least second component, and wherein the equilibrium phase does not exhibit physical characteristics of the at least first component in an unmixed state and the at least second component in an unmixed state; wherein the at least first component and the at least second component form an intermolecular interaction between each other sufficient to prevent crystallization of the at least first component and the at least second component in the eutectic mixture; and wherein the eutectic mixture is a liquid at 20° C.

10. A lubricating engine oil having a composition comprising a lubricating oil base stock as a major component; and a eutectic mixture co-base stock, as a minor component; wherein the eutectic mixture co-base stock comprises at least a first component comprising a hydrogen bond acceptor and at least a second component comprising a hydrogen bond donor; wherein the eutectic mixture comprises an equilibrium phase between the at least first component and the at least second component, and wherein the equilibrium phase does not exhibit physical characteristics of the at least first component in an unmixed state and the at least second component in an unmixed state; wherein the at least first component and the at least second component form an intermolecular interaction between each other sufficient to prevent crystallization of the at least first component and the at least second component in the eutectic mixture; and wherein the eutectic mixture is a liquid at 20° C.

11. The lubricating engine oil of clause 10 wherein wear control is improved and/or friction is reduced and fuel efficiency is maintained or improved as compared to wear control and/or friction reduction and fuel efficiency achieved using a lubricating engine oil containing a co-base stock other than the eutectic mixture co-base stock.

12. The lubricating engine oil of clause 10 further comprising one or more of an anti-wear additive, viscosity modifier, antioxidant, other detergent, dispersant, pour point depressant, corrosion inhibitor, metal deactivator, seal compatibility additive, anti-foam agent, inhibitor, and anti-rust additive.

13. A multifunctional functional fluid comprising: a eutectic mixture containing at least a first component comprising a hydrogen bond acceptor and at least a second component comprising a hydrogen bond donor; wherein the eutectic mixture comprises an equilibrium phase between the at least first component and the at least second component, and wherein the equilibrium phase does not exhibit physical characteristics of the at least first component in an unmixed state and the at least second component in an unmixed state; wherein the at least first component and the at least second component form an intermolecular interaction between each other sufficient to prevent crystallization of the at least first component and the at least second component in the eutectic mixture; and wherein the eutectic mixture is a liquid at 20° C.

14. A method for improving wear control and/or reducing friction, while maintaining or improving fuel efficiency, in an engine lubricated with a lubricating oil by using as the lubricating oil a formulated oil, said formulated oil having a composition comprising a lubricating oil base stock as a major component; and a eutectic mixture co-base stock, as a minor component; wherein the eutectic mixture co-base stock comprises at least a first component comprising a hydrogen bond acceptor and at least a second component comprising a hydrogen bond donor; wherein the eutectic mixture comprises an equilibrium phase between the at least first component and the at least second component, and wherein the equilibrium phase does not exhibit physical characteristics of the at least first component in an unmixed state and the at least second component in an unmixed state; wherein the at least first component and the at least second component form an intermolecular interaction between each other sufficient to prevent crystallization of the at least first component and the at least second component in the eutectic mixture; and wherein the eutectic mixture is a liquid at 20° C.

15. The composition of clause 1 for use in performance additive chemistry, separation, analytics, syntheses, electrochemistry, engineering fluids, and/or material syntheses.

All patents and patent applications, test procedures (such as ASTM methods, UL methods, and the like), and other documents cited herein are fully incorporated by reference to the extent such disclosure is not inconsistent with this disclosure and for all jurisdictions in which such incorporation is permitted.

When numerical lower limits and numerical upper limits are listed herein, ranges from any lower limit to any upper limit are contemplated. While the illustrative embodiments of the disclosure have been described with particularity, it will be understood that various other modifications will be apparent to and can be readily made by those skilled in the art without departing from the spirit and scope of the disclosure. Accordingly, it is not intended that the scope of the claims appended hereto be limited to the examples and descriptions set forth herein but rather that the claims be construed as encompassing all the features of patentable novelty which reside in the present disclosure, including all features which would be treated as equivalents thereof by those skilled in the art to which the disclosure pertains.

The present disclosure has been described above with reference to numerous embodiments and specific examples. Many variations will suggest themselves to those skilled in this art in light of the above detailed description. All such obvious variations are within the full intended scope of the appended claims.

What is claimed is:

1. A composition comprising: a eutectic mixture of at least a first component comprising a hydrogen bond acceptor and at least a second component comprising a hydrogen bond donor; wherein the eutectic mixture comprises an equilibrium phase between the at least first component and the at least second component, and wherein the equilibrium phase does not exhibit physical characteristics of the at least first component in an unmixed state and the at least second component in an unmixed state; wherein the at least first component and the at least second component form an intermolecular interaction between each other sufficient to prevent crystallization of the at least first component and the at least second component in the eutectic mixture; and wherein the eutectic mixture is a liquid at 20° C.;

wherein the composition comprises a synthetic base stock, a synthetic co-base stock, a functional fluid, or a lubricant additive.

2. The composition of claim 1 which has a kinematic viscosity at a temperature of 100° C. ($Kv_{100}$), measured according to ASTM standard D-445, from about 2 to about 300 cst, a kinematic viscosity at a temperature of 40° C. ($Kv_{40}$), measured according to ASTM standard D-445, from about 5 to about 4000 cst, a viscosity index (VI), measured according to ASTM standard D-2270, from about −100 to about 300, and a Noack volatility, measured according to ASTM D-5800, of no greater than about 90 percent.

3. The composition of claim 1 which has a kinematic viscosity at a temperature of 100° C. ($Kv_{100}$), measured according to ASTM standard D-445, from about 2.2 to about 200 cst, a kinematic viscosity at a temperature of 40° C. ($Kv_{40}$), measured according to ASTM standard D-445, from about 20 to about 2000 cst, a viscosity index (VI), measured according to ASTM standard D-2270, from about 50 to about 250, and a Noack volatility, measured according to ASTM D-5800, of no greater than about 50 percent.

4. The composition of claim 1 wherein the at least first component in an unmixed state is a solid at 20° C. and the at least second component in an unmixed state is a solid at 20° C.

5. The composition of claim 1 wherein the intermolecular interaction comprises hydrogen bonding or Van der Waals force.

6. The composition of claim 1 wherein the eutectic mixture is anhydrous.

7. The composition of claim 1 wherein the hydrogen bond acceptor comprises an amino acid, a salt including an organic salt and natural salt, or mixtures thereof.

8. The composition of claim 1 wherein the hydrogen bond donor comprises an organic acid, alcohol, polyol, aldehyde, carbohydrate, saccharide, or mixtures thereof.

9. The composition of claim 1 wherein the hydrogen bond acceptor comprises tetraoctylphosphonium bromide, (2-hydroxyethyl)trimethylammonium chloride (choline), 1-ethyl-3-methylimidazolium bromide, tributyldodecylphosphonium bromide, tetrahexylammonium chloride, ethylammonium chloride, tetramethylammonium chloride, alanine, betaine, glycine, histidine, proline, ethyl(2-hydroxyethyl)-dimethylammonium chloride, chloline nitrate, trimethylammonium chloride, triethylammonium bromide, chloline tetrafluoroborate, chlorochloline chloride, 2-fluoroethyl-trimethylammonium bromide, acetylchloline chloride, choline fluoride, benzyldimethyl(2-hydroxyethyl)-ammonium chloride, diethyl(2-hydroethyl)-ammonium chloride, lidocaine, tetrabutylammonium chloride, (phenylmethyl)triphenyl phosphonium chloride, methyltriphenylphosphonium bromide, tributyloctylphosphonium bromide, 1-ethyl-3-methylimidazolium chloride, tetraoctylammonium bromide, methyltrioctylammonium bromide, 1-butyl-3-methylimidazolium chloride, tetrabutylphosphonium methanesulfonate, (2-hydroxyethyl)benzyldimethylammonium chloride, trihexyltetradecylphosphonium chloride, trihexyltetradecylphosphonium bromide, (2-chloroethyl)trimethylammonium chloride, (2-chloroethyl)trimethylammonium bromide, (2-acetoxy)trimethylammonium chloride, or mixtures thereof.

10. The composition of claim 1 wherein the hydrogen bond donor comprises lactic acid, malic acid, oxalic acid (anhydrous or dihydrate), nicotinic acid, acetamide, malonic acid, xylitol, urea, 1,2-dimethylurea, D-isosorbide, tartatic acid, tricarballylic acid, thiourea, trifluoroacetamide, benzoic acid, itaconic acid, citric acid, imidazole, 2-imidazolinone, benzamide, 4-hydroxybenzoic acid, cinnamic acid, ethylene glycol, propylene urea, resorcinol, phenylacetic acid, D-sorbitol, 1,3-dimethylurea, levulinic acid, gallic acid, caffeic acid, 1-methylurea, glycerol, succinic acid, hexanoic acid, coumaric acid, stearic acid, oleic acid, linoleic acid, adipic acid, suberic acid, decanoic acid, trichloroacetic acid, phenlyacetic acid, p-toluene sulfonic acid, cresol, phenol, ethylene glycol, glycerol, fructose, phenothiazine, or mixtures thereof.

11. A process comprising:

providing at least a first component comprising a hydrogen bond acceptor and at least a second component comprising a hydrogen bond donor; wherein the at least first component and the at least second component are solids at 20° C.;

heating either the at least first component or the at least second component, whichever has the lowest melting point, at a temperature sufficient to melt either the at least first component or the at least second component having the lowest melting point; and dissolving either the at least first component or the at least second component, whichever does not have the lowest melting point, in either the melted at least first component or the melted at least second component, to form a eutectic mixture;

wherein the eutectic mixture comprises an equilibrium phase between the at least first component and the at least second component, and wherein the equilibrium phase does not exhibit physical characteristics of the at least first component and the at least second component; wherein the at least first component and the at least second component form an intermolecular interaction between each other sufficient to prevent crystallization of the at least first component and the at least second component in the eutectic mixture; and wherein the eutectic mixture is a liquid at 20° C.;

wherein the eutectic mixture is a synthetic base stock, a synthetic co-base stock, a functional fluid, or a lubricant additive.

12. The process of claim 11 wherein the intermolecular interaction comprises hydrogen bonding or Van der Waals force.

13. The process of claim 11 wherein the eutectic mixture is anhydrous.

14. The process of claim 11 wherein the hydrogen bond acceptor comprises an amino acid, a salt including an organic salt and natural salt, or mixtures thereof.

15. The process of claim 11 wherein the hydrogen bond donor comprises an organic acid, alcohol, polyol, aldehyde, carbohydrate, saccharide, or mixtures thereof.

16. The process of claim 11 wherein the hydrogen bond acceptor comprises tetraoctylphosphonium bromide, (2-hydroxyethyl)trimethylammonium chloride (choline), 1-ethyl-3-methylimidazolium bromide, tributyldodecylphosphonium bromide, tetrahexylammonium chloride, ethylammonium chloride, tetramethylammonium chloride, alanine, betaine, glycine, histidine, proline, ethyl(2-hydroxyethyl)-dimethylammonium chloride, chloline nitrate, trimethylammonium chloride, triethylammonium bromide, chloline tetrafluoroborate, chlorochloline chloride, 2-fluoroethyl-trimethylammonium bromide, acetylchloline chloride, choline fluoride, benzyldimethyl(2-hydroxyethyl)-ammonium chloride, diethyl(2-hydroethyl)-ammonium chloride, lidocaine, tetrabutylammonium chloride, (phenylmethyl)triphenyl phosphonium chloride, methyltriphenylphosphonium bromide, tributyloctylphosphonium bromide, 1-ethyl-3-methylimidazolium chloride, tetraoctylammonium bromide, methyltrioctylammonium bromide, 1-butyl-3-methylimidazolium chloride, tetrabutylphosphonium methanesulfonate, (2-hydroxyethyl)benzyldimethylammonium chloride, trihexyltetradecylphosphonium chloride, trihexyltetradecylphosphonium bromide, (2-chloroethyl)trimethylammonium chloride, (2-chloroethyl)trimethylammonium bromide, (2-acetoxy)trimethylammonium chloride, or mixtures thereof.

17. The process of claim 11 wherein the hydrogen bond donor comprises lactic acid, malic acid, oxalic acid (anhydrous or dihydrate), nicotinic acid, acetamide, malonic acid, xylitol, urea, 1,2-dimethylurea, D-isosorbide, tartatic acid, tricarballylic acid, thiourea, trifluoroacetamide, benzoic acid, itaconic acid, citric acid, imidazole, 2-imidazolinone, benzamide, 4-hydroxybenzoic acid, cinnamic acid, ethylene glycol, propylene urea, resorcinol, phenylacetic acid, D-sorbitol, 1,3-dimethylurea, levulinic acid, gallic acid, caffeic acid, 1-methylurea, glycerol, succinic acid, hexanoic acid, coumaric acid, stearic acid, oleic acid, linoleic acid, adipic acid, suberic acid, decanoic acid, trichloroacetic acid, phenlyacetic acid, p-toluene sulfonic acid, cresol, phenol, ethylene glycol, glycerol, fructose, phenothiazine, or mixtures thereof.

18. The process of claim 11 wherein the eutectic mixture has a kinematic viscosity at a temperature of 100° C. ($Kv_{100}$), measured according to ASTM standard D-445, from about 2 to about 300 cst, a kinematic viscosity at a temperature of 40° C. ($Kv_{40}$), measured according to ASTM standard D-445, from about 5 to about 4000 cst, a viscosity index (VI), measured according to ASTM standard D-2270, from about −100 to about 300, and a Noack volatility, measured according to ASTM D-5800, of no greater than about 90 percent.

19. The process of claim 11 wherein the eutectic mixture has a kinematic viscosity at a temperature of 100° C. ($Kv_{100}$), measured according to ASTM standard D-445, from about 2.2 to about 200 cst, a kinematic viscosity at a temperature of 40° C. ($Kv_{40}$), measured according to ASTM standard D-445, from about 20 to about 2000 cst, a viscosity index (VI), measured according to ASTM standard D-2270, from about 50 to about 250, and a Noack volatility, measured according to ASTM D-5800, of no greater than about 50 percent.

20. A composition prepared by the process of claim 11.

* * * * *